United States Patent [19]

Aoki et al.

[11] Patent Number: 4,898,812

[45] Date of Patent: Feb. 6, 1990

[54] SILVER HALIDE COLOR PHOTOGRAPHIC MATERIAL WITH A SILVER HALIDE EMULSION LAYER CONTAINING A CYAN COUPLER AND A COLOR DEVELOPMENT ACCELERATOR

[75] Inventors: Kozo Aoki; Nobuo Furutachi, both of Kanagawa, Japan

[73] Assignee: Fuji Photo Film Co., Ltd., Kanagawa, Japan

[21] Appl. No.: 82,461

[22] Filed: Aug. 7, 1987

[30] Foreign Application Priority Data

Aug. 7, 1986 [JP] Japan ..... 61-184329

[51] Int. Cl.[4] ..... G03C 7/34

[52] U.S. Cl. ..... 430/548; 430/487; 430/546; 430/550; 430/552; 430/553

[58] Field of Search ..... 430/552, 553, 487, 505, 430/558, 385, 386, 546, 550, 548

[56] References Cited

U.S. PATENT DOCUMENTS

| | | | |
|---|---|---|---|
| 2,184,023 | 12/1939 | Sheppard et al. | 430/607 |
| 3,307,948 | 3/1967 | Thiers et al. | 430/487 |
| 4,038,081 | 10/1977 | Habu et al. | 430/487 |
| 4,207,393 | 6/1980 | Snyder | 430/546 |
| 4,267,263 | 5/1981 | Kunitz et al. | 430/487 |
| 4,327,173 | 4/1982 | Aoki et al. | 430/552 |
| 4,363,871 | 12/1982 | Shibue et al. | 430/536 |
| 4,363,873 | 12/1982 | Boon et al. | 430/546 |
| 4,385,108 | 5/1983 | Takagi et al. | 430/487 |
| 4,471,048 | 9/1984 | Fryberg et al. | 430/487 |
| 4,564,586 | 1/1986 | Aoki et al. | 430/553 |
| 4,668,610 | 5/1987 | Delprato et al. | 430/553 |

FOREIGN PATENT DOCUMENTS

| | | |
|---|---|---|
| 255730 | 2/1988 | European Pat. Off. . |
| 1447761 | 2/1969 | Fed. Rep. of Germany . |
| 326163 | 1/1983 | Fed. Rep. of Germany . |
| 944061 | 3/1949 | France . |
| 944294 | 3/1949 | France . |
| 1406295 | 6/1965 | France . |
| 2119737 | 8/1972 | France . |
| 59-178451 | 9/1984 | Japan . |
| 2068943 | 8/1981 | United Kingdom . |

OTHER PUBLICATIONS

Derwent Abstracts, vol. 10, No. 195, (p. 475) (2251) Jul. 1986, Satoshi Matsunaga.

Derwent Abstracts, vol. 10, No. 143, (p. 459) (2200) May 27, 1986, Tadahisa Satou.

Derwent Abstract, vol. 9, No. 37, (p. 335) 1760 Feb. 6, 1985, Yukihiko Sakaguchi.

Chemical Abstracts 6001, vol. 77, Jul. 10, 1972, No. 2, p. 12287.

Derwent Abstract, No. 249 (p. 234) (1394) Nov. 5, 1983, Masaru Iwagaki.

*Primary Examiner*—Richard L. Schilling

*Attorney, Agent, or Firm*—Sughrue, Mion, Zinn, Macpeak & Seas

[57] ABSTRACT

A silver halide color photographic material comprising a support having thereon at least one silver halide emulsion layer, said emulsion layer containing at least one cyan dye forming coupler represented by the general formula (I):

(I)

wherein, $Q_1$ contains at least one nitrogen atom and represents a group of atoms that are combined to form, together with a carbon atoms attached thereto a 5- or more membered nitrogen-containing heterocyclic ring;

$Z_1$ represents a hydrogen atom or a group that can be released in a coupling reaction with the oxidation product of a color developing agent;

R represents an acyl group or a sulfonyl group; and

R' represents a hydrogen atom or an aliphatic group having 1 to 8 carbon atoms which may be substituted with one or more substituents; and a dimer coupler or a polymer coupler may be formed through R, R', $Z_1$ or $Q_1$;

and at least one color development accelerator.

The silver halide color photographic material has increased $D_{max}$ and sensitivity.

10 Claims, No Drawings

SILVER HALIDE COLOR PHOTOGRAPHIC MATERIAL WITH A SILVER HALIDE EMULSION LAYER CONTAINING A CYAN COUPLER AND A COLOR DEVELOPMENT ACCELERATOR

FIELD OF THE INVENTION

The present invention relates to a silver halide color photographic material that contain a condensed ring type cyan dye forming coupler and a color development accelerator.

BACKGROUND OF THE INVENTION

After a silver halide photographic material is exposed to light, the silver halide photographic material is ordinarily subjected to color development treatment, during which a developing agent, such as an aromatic primary amine that has been oxidized with the silver halide, reacts with a dye forming coupler so that a color image is formed. Generally, in this process, the color reproduction method by the subtractive color process is often used and to reproduce blue, green and red colors, dye images that are complementary colors to them, namely yellow, magenta and cyan, are formed.

Many phenols and naphthols are used as cyan color image forming couplers. However, the shelf stability of the color images obtained from phenols and naphthols that are conventionally used still have some problems that remain unsolved. For example, color images obtained from 2-acylaminophenol cyan couplers described in U.S. Pat. Nos. 2,367,531, 2,369,929, 2,423,730 and 2,801,171 are generally poor in heat fastness, color images obtained from 2,5-diacylaminophenol cyan couplers described in U.S. Pat. Nos. 2,772,162 and 2,895,826 are generally poor in light fastness, and color images obtained from 1-hydroxy-2-naphthamide cyan couplers are generally poor in both light and heat (particularly moist heat) fastnesses.

Although 5-hydroxy-6-acylaminocarbostyril cyan couplers described in Japanese Patent Application (OPI) Nos. 104333/81 and 159861/85 (the term "OPI" as used herein means a "published unexamined Japanese patent applicaiton") and 4-hydroxy-5-acylaminohydroxyindol couplers, 4-hydroxy-5-acylamino-2,3-dihydro-1,3-benzimidazol-2-one couplers, etc. described in Japanese Patent Application (OPI) No. 105229/83 which are included as condensed ring type cyan dye forming couplers are excellent in light and heat fastness, since their color development speed is not sufficient, their sensitivity is disadvantageously low and their maximum color development density (hereinafter referred to as $D_{max}$) is somewhat low. More recently, in view of the need to reduce the risk of harm to public health due to disposal of used developer containing benzyl alcohol, there is a movement to use color developers and treating liquids which do not contain benzyl alcohol. A problem which is not restricted to cyan dye forming couplers is that when couplers are processed with a color developer without benzyl alcohol, sensitivity and $D_{max}$ are reduced. This problem is observed with yellow dye forming couplers and magenta dye forming couplers as well as cyan dye forming couplers, but is particularly noticeable in the case of condensed ring type cyan dye forming couplers (hereinafter referred to as cyan couplers).

Even though various color development accelerators (e.g., compounds described in U.S. Pat. Nos. 2,950,970, 2,515,147, 2,496,903, 2,304,925, 4,038,075 and 4,119,462, British Pat. Nos. 1,430,998 and 1,455,413, Japanese Patent Application (OPI) Nos. 15831/78, 62450/80, 62451/80, 62452/80, 62453/80, 50536/83, and 162256/85 and Japanese Patent Publication Nos. 12422/76 and 49728/80) have been additionally used to attempt to solve this problem, sufficient color density has not yet been attained.

Even if built-in color developing agents (e.g., as described in U.S. Pat. Nos. 3,719,492, 3,342,559 and 3,342,597, and Japanese Patent Application (OPI) Nos. 6235/81, 16133/81, 97531/82 and 83565/82) are used, color development becomes disadvantageously slow or fogging occurs, which means that the prior art methods using the built-in color developing agents are not suitable.

SUMMARY OF THE INVENTION

An object of the present invention is to provide a color photographic material using a condensed ring type cyan coupler in which the developability of the coupler is increased, greater sensitivity is achieved, a high $D_{max}$ can be attained, and, particularly, can be processed in a short period of time even by a color developer which does not substantially contain benzyl alcohol.

The above object has been attained by providing a silver halide color photographic material comprising a support having thereon at least one silver halide emulsion layer, the emulsion layer containing at least one cyan dye forming coupler represented by the general formula (I):

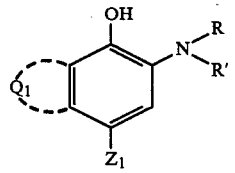

(I)

wherein $Q_1$ contains at least one nitrogen atom and represents a group of atoms that are combined to form, together with the carbon atoms attached thereto, a 5- or more membered nitrogen-containing heterocyclic ring, $Z_1$ represents a hydrogen atom or a group which can be released in a coupling reaction with the oxidation product of a color developing agent (hereinafter referred to as a coupling off group), R represents an acyl group or a sulfonyl group, and R' represents a hydrogen atom or an aliphatic group having 1 to 8 carbon atoms which may be substituted with one or more substituents, and a dimer coupler or a polymer coupler may be formed through R, R', $Z_1$ or $Q_1$; and at least one color development accelerator represented by the general formulae (II) to (VIII):

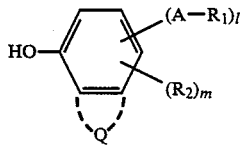

(II)

$$HOOC-DR_3 \quad \text{(III)}$$

$$Y_1-O\left(R_{10}-O\right)_n R_4 \quad \text{(IV)}$$

$$R_5-NHSO_2-R_6 \quad \text{(V)}$$

$$R_7-CONHCO-R_8 \quad \text{(VI)}$$

-continued

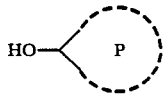

(VII)

$HO-R_9$ (VIII)

wherein, A represents a divalent electron accepting group, $R_1$ represents a substituted or unsubstituted aliphatic group, a substituted or unsubstituted aryl group, a substituted or unsubstituted alkoxy gorup, a substituted or unsubstituted aryloxy group, a substituted or unsubstituted alkylamino group, a substituted or unsubstituted anilino group, or a substituted or unsubstituted heterocyclic group, l is 1 or 2, $R_2$ represents a substituted or unsubstituted aliphatic group, a substituted or unsubstituted alkoxy gorup, a hydroxyl group, or a halogen atom, m is an integer of from 0 to 4, Q, which may or may not be present, represents a benzene ring or heterocyclic ring that may be condensed with the phenol ring, $R_3$ represents a substituted or unsubstituted aliphatic group, a substituted aryl gorup, or a substituted heterocyclic group, $Y_1$ represents a substituted or unsubstituted aryl group, a substituted or unsubstituted aliphatic group, a substituted or unsubstituted heterocyclic group, a group

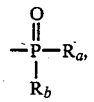

or a group

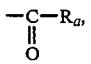

$R_{10}$ represents a substituted or unsubstituted alkylene group, a substituted or unsubstituted arylene group, or a substituted or unsubstituted aralkylene group, $R_4$ represents a substituted or unsubstituted aliphatic group or a substituted or unsubstituted aryl group, with the proviso that $Y_1$ and $R_4$ do not represent an aliphatic group at the same time, $R_a$ and $R_b$, which may be the same or different, each represents a substituted or unsubstituted aliphatic group, a substituted or unsubstituted aryl group, a substituted or unsubstituted amino group, a substituted or unsubstituted alkoxy group or a substituted or unsubstituted aryloxy group, n is an integer of 1 to 5, $R_5$ represents a substituted or unsubstituted aliphatic group, a substituted or unsubstituted aryl group, a substituted or unsubstituted alkylsulfonyl or phenylsulfonyl group or a substituted or unsubstituted acyl group, $R_6$ has the same meaning as $R_4$, and $R_5$ and $R_6$ may combine to form a 5- to 7-membered ring, which ring may be independent or may be part of a fused ring system, $R_7$ and $R_8$ have the same meaning as $R_4$, or $R_7$ and $R_8$ may combine to form a 5- to 7-membered ring, which ring may be independent or may be part of a fused ring system,

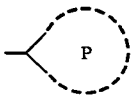

represents a substituted or unsubstituted 5- to 7-membered heterocyclic ring group, which ring may be independent or may be part of a fused ring system, and $R_9$ represents a substituted or unsubstituted aliphatic group containing at least one alkyl group with a total of 12 or more carbon atoms.

DETAILED DESCRIPTION OF THE INVENTION

Substituents of cyan couplers represented by the general formula (I) are described in detail below.

$Q_1$ contains at least one nitrogen atom and represents a group of atoms combined to form, together with the carbon atoms attached thereto, a 5- or more membered nitrogen-containing heterocyclic ring, and examples of divalent groups forming the ring excluding the nitrogen atom, include at least one divalent group which is a divalent amino group, an ether linkage, a thioether linkage, an alkylene group, an ethylene linkage, an imino linkage, a sulfonyl group, a carbonyl group, an allylene group, a divalent heterocyclic ring group and a group represented by

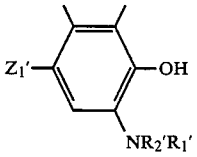

wherein $Z'_1$, $R'_1$ and $R'_2$, respectively, have the same meaning as $Z_1$, R and R' defined below and may be the same or different. These divalent group in $Q_1$ may be used alone or may be combined and may have at least one substituent.

In the general formula (I), preferably $Q_1$ represents a group represented by $—NR'_3CO—Q'_1—$ wherein $Q'_1$ represents a divalent group. Examples of $Q'_1$ include a divalent amino group, an ether linkage, a thioether linkage, an alkylene group, an ethylene linkage, an imino linkage, a sulfonyl group, a carbonyl group, an allylene group, a divalent heterocyclic ring group, and a group represented by

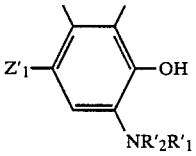

wherein $Z'_1$, $R'_1$, and $R'_2$, respectively, have the same meaning as $Z_1$, R and R' defined below and may be the same or different. The divalent groups represented by $Q'_1$ may be used alone or may be combined and the divalent group may be substituted.

In the general formula (I), $Z_1$ represents a hydrogen atom or a coupling off group, and examples of the coupling off group include a halogen atom (e.g., a fluorine atom, a chlorine atom, and a bromine atom), an alkoxy group (e.g., an ethoxy group, a dodecyloxy group, a methoxyethylcarbamoylmethoxy group, a carboxypropyloxy group, and a methylsulfonylethoxy group), an aryloxy group (e.g., a 4-chlorophenoxy group, a 4-methoxyphenoxy group, and a 4-carboxyphenoxy group), an acyloxy group (e.g., an acetoxy group, a tetradecanoyloxy group, and a benzoyloxy group), a sulfonyloxy group (e.g., a methanesulfonyloxy group, and a toluenesulfonyloxy group), an amido group (e.g., a dichloroacetylamino group, a heptafluorobutyrylamino group, a methanesulfonylamino group, and a toluenesulfonylamino group), an alkoxycarbonyloxy group (e.g., an ethoxycarbonyloxy group, and a benzyloxycarbonyloxy group), an aryloxycarbonyloxy group (e.g., a phenoxycarbonyloxy group), an aliphatic or aromatic thio group (e.g., an ethylthio group, a phenylthio group, and a tetrazolylthio group), an imido group (e.g., a succinimido group, and a hydantoinyl group), an aromatic azo group (e.g., a phenylazo group), etc. These coupling off groups may contain a photographiclly useful group, such as a group containing development inhibitor, a group containing development accelerator, and a group containing chromophoric group (e.g., atomic group having azo-bonding).

In the general formula (I), R represents a group represented by $—CO—X_1—R'_4$ or $—SO_2—X_1—R'_4$ wherein $X_1$ represents —O—, $—NR'_5—$ or a chemical bond, and $R'_4$ represents a chain-like or ring-like aliphatic group preferably having 1 to 32 carbon atoms (e.g., a methyl group, a butyl group, a tridecyl group, and a cyclohexyl group), an aryl group (e.g., a phenyl group, and a naphthyl group), or a heterocyclic ring (e.g., a 2-pyridyl group, a 2-imidazolyl group, a 2-furyl group, and a 6-quinolyl group). These groups may be substituted by a group selected from an alkyl group, an aryl group (e.g., a phenyl group), a heterocyclic group, an alkoxy group (e.g., a methoxy group, and a 2-methoxyethoxy group), an aryloxy group (e.g., a 2,4-di-tert-amylphenoxy group, a 2-chlorophenoxy group, and a 4-cyanophenoxy group), an alkenyloxy group (e.g., a 2-propenyloxy group), an acyl group (e.g., an acetyl group, and a benzoyl group), an ester group (e.g., a butoxycarbonyl group, a phenoxy carbonyl group, an acetoxy group, a benzoyloxy group, a butoxysulfonyl group, and a toluenesulfonyloxy group), an amido group (e.g., an acetylamino group, an ethylcarbamoyl group, a dimethylcarbamoyl group, a methanesulfonamido group, and a butylsulfamoyl group), a sulfamido group (e.g., a dipropylsulfamoylamino group), an imido group (e.g., a succinimido group, and a hydantoinyl group), a ureido group (e.g., a phenylureido group, and a dimethylureido group), an aliphatic or aromatic sulfonyl group (e.g., a methanesulfonyl group, and a phenylsulfonyl group), an aliphatic or aromatic thio group (e.g., an ethylthio group, and a phenylthio group), a hydroxy group, a cyano group, a carboxy group, a nitro group, a sulfo group, a halogen atom, etc.

The aliphatic groups mentioned in relation to the formula (I) above may be linear, branched or cyclic and may be saturated or unsaturated.

R' and $R'_5$ each represents a hydrogen atom or an aliphatic group having from 1 to 8 carbon atoms (e.g., a methyl group, an ethyl group, an iso-propyl group, a cyclohexyl group, a 2-ethylhexyl group, and an allyl group) which may be substituted with one or more of the substituents allowed for $R'_4$.

$R'_3$ represents a hydrogen atom or a group represented by $—X_2—R'_6$ that can be attached as a substituent to the nitrogen atom and wherein $X_2$ represents a chemical bond or a divalent linking group, such as divalent amino group, an ether linkage, a thioether linkage, an alkylene group, an ethylene linkage, an imino linkage, a sulfonyl group, a sulfoxy group, a carbonyl group, etc., that may be used alone or in combination with one another and may be substituted with one or more of the substituents allowed for $R'_4$, and $R'_6$ has the same meaning as $R'_4$ defined above.

In the general formula (I), preferably $Z_1$ represents a hydrogen atom, a halogen atom, an aryloxy group, or an alkoxy group, with a chlorine atom being particularly preferred.

In the general formula (I), preferably the ring formed by $Q_1$ is a 5- to 8-membered ring, with a 5- to 7-membered ring being particularly preferred.

In the general formula (I), $R'_3$ preferably represents a hydrogen atom or an alkyl group (preferably having from 1 to 12 carbon atoms), with a hydrogen atom being particularly preferred.

In the general formula (I), $R'_1$ preferably represents a group represented by $—COX_1—R'_4$ and more preferably represents a group represented by $—COX_1—R'_4$ wherein $X_1$ represents a chemical bond (i.e., a group $—CO—R'_4$).

In the general formula (I), R' preferably represents a hydrogen atom.

In the general formula (I), when a dimer coupler is formed, it is preferably to be formed through $Q_1$ or R.

In the general formula (I), when a polymer coupler is formed, it is preferably formed through $Z_1$ or R, and more preferably through R.

Specific examples of cyan couplers to be contained in the silver halide color photographic materials according to the present invention are given below, which should not be construed to in any way limit the scope of the present invention.

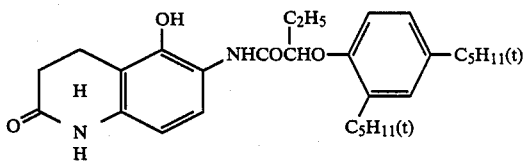

(C-1)

-continued
(C-2)
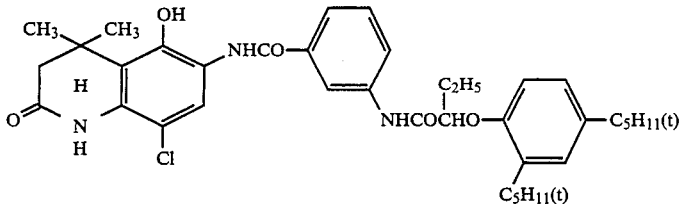
(C-3)
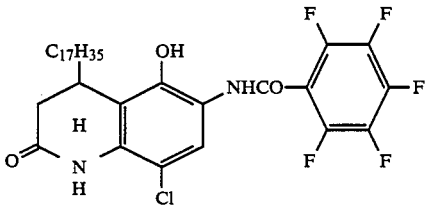
(C-4)
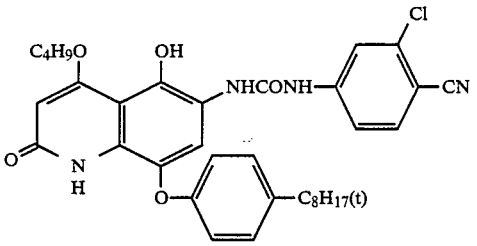
(C-5)
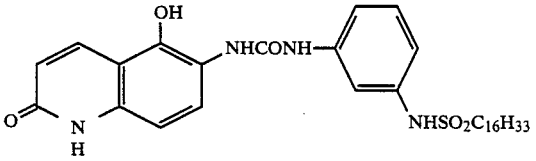
(C-6)
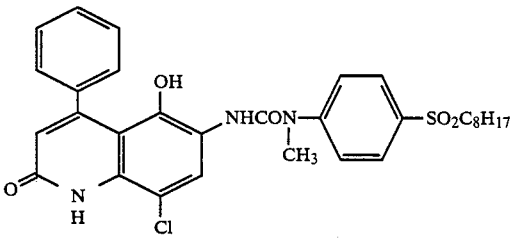
(C-7)
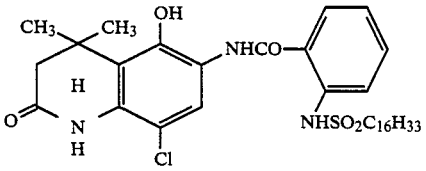
(C-8)
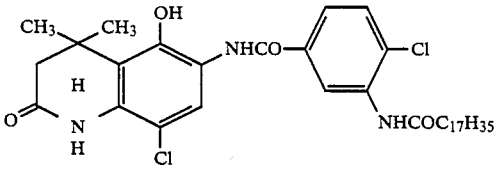

-continued
(C-9)
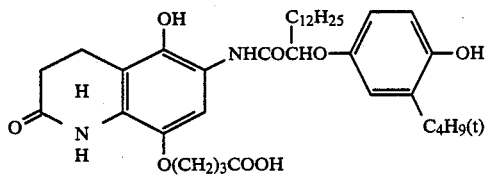
(C-10)
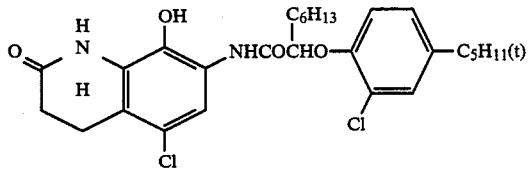
(C-11)
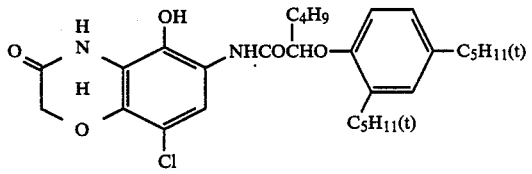
(C-12)
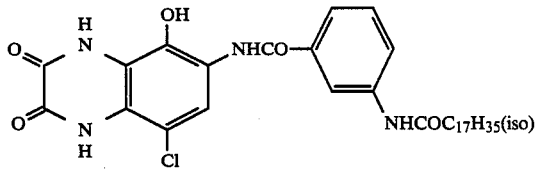
(C-13)
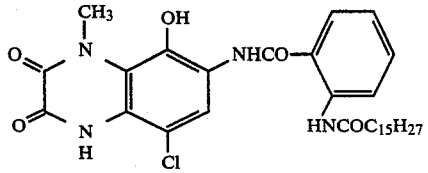
(C-14)
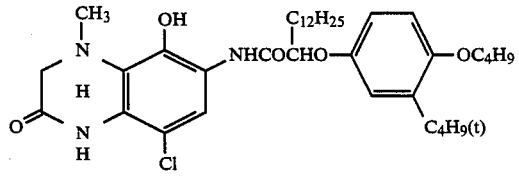
(C-15)
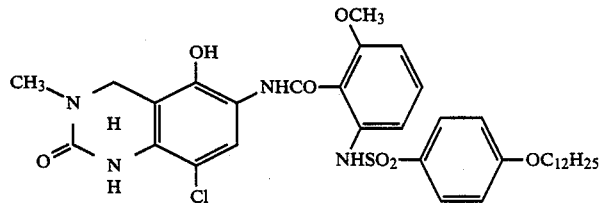
(C-16)
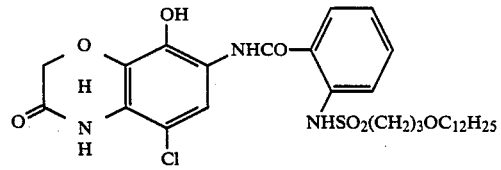

-continued
(C-17)
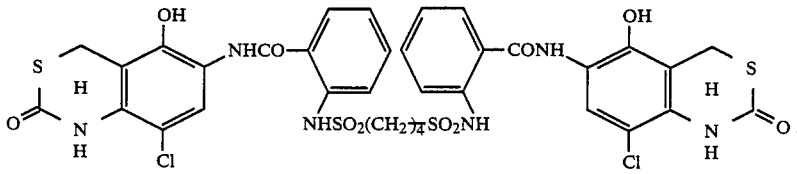
(C-18)
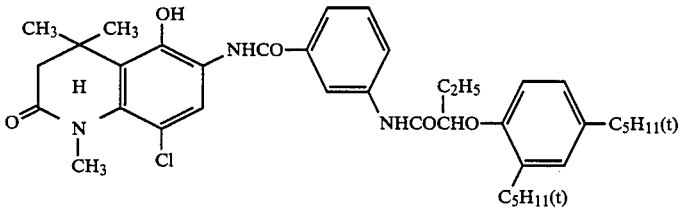
(C-19)
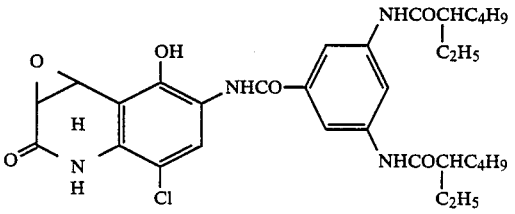
(C-20)
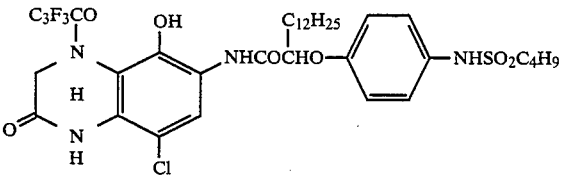
(C-21)
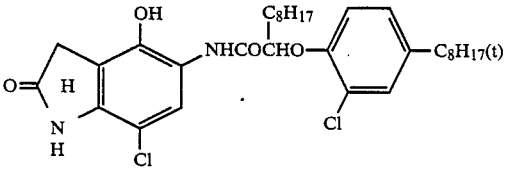
(C-22)
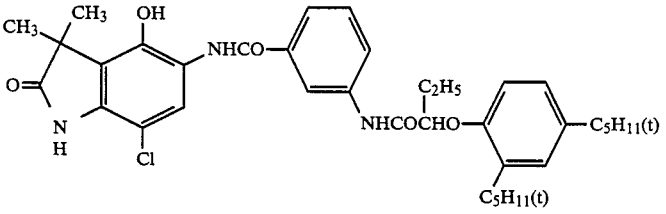
(C-23)
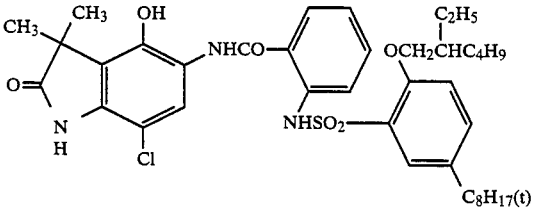
(C-24)
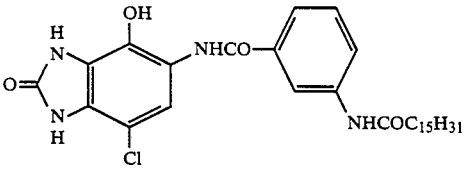

-continued
(C-25)
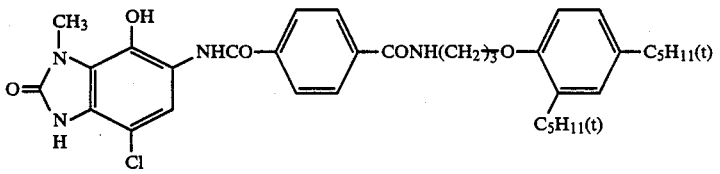
(C-26)
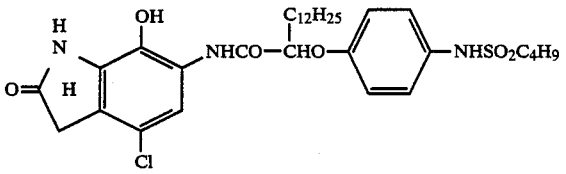
(C-27)
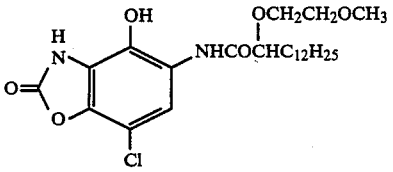
(C-28)
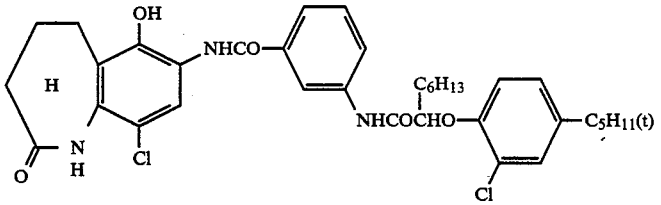
(C-29)
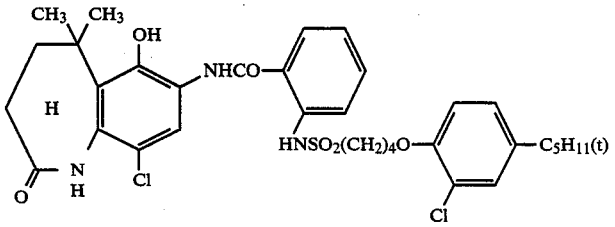
(C-30)
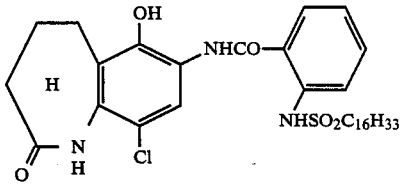
(C-31)
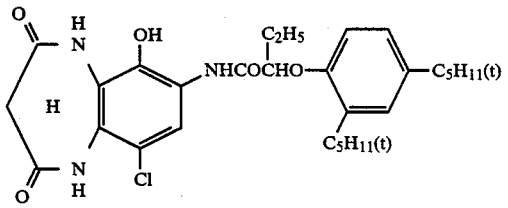
(C-32)
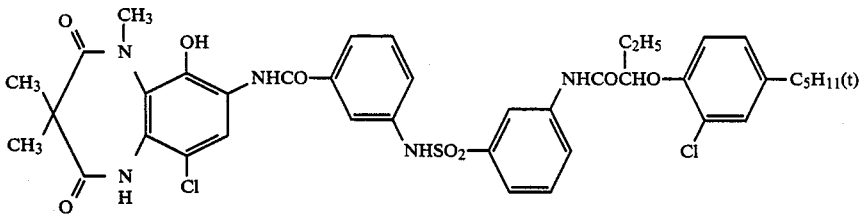

-continued
(C-33)
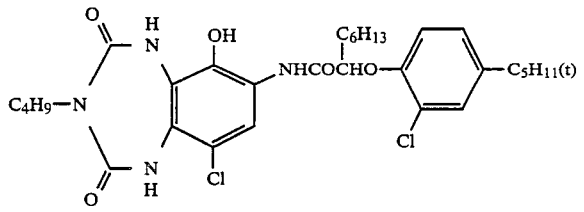
(C-34)
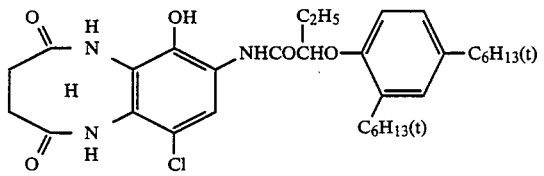
(C-35)
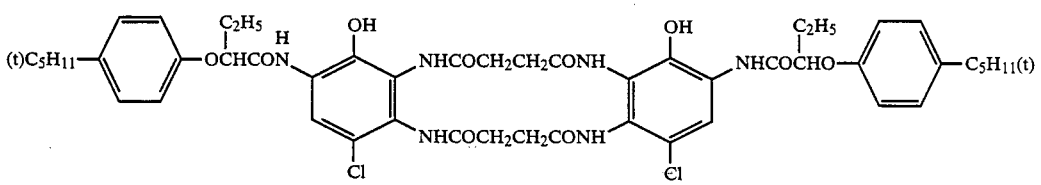
(C-36)
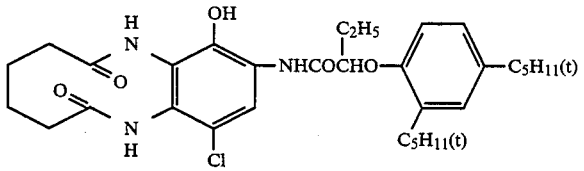
(C-37)
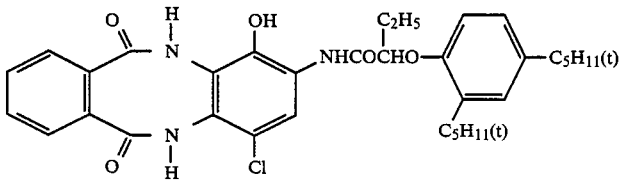
(C-38)
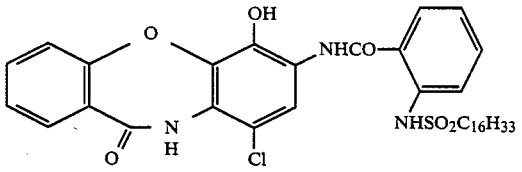
(C-39)
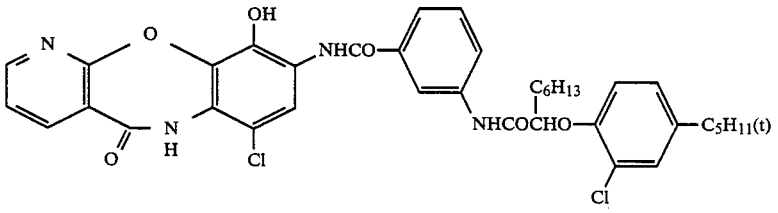
(C-40)
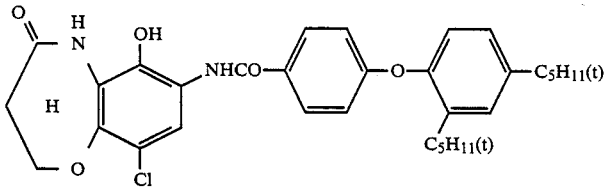

-continued
(C-41)
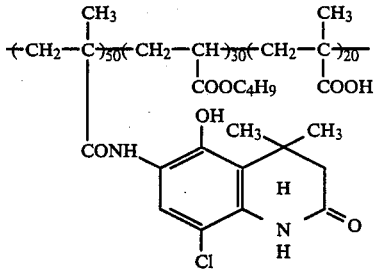
Subscripts 50, 30, and 20 represent the weight ratio of units in the polymer. These units may be present randomly.
(C-42)
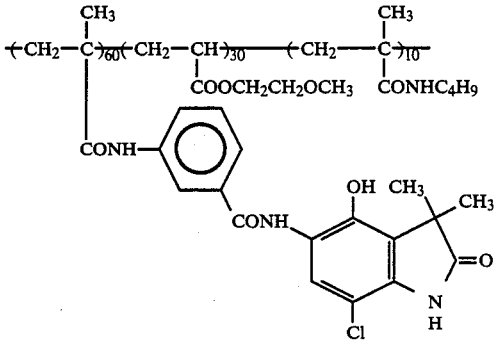
Subscripts 60, 30, and 10 represent the weight ratio of units in the polymer. These units may be present randomly.
(C-43)
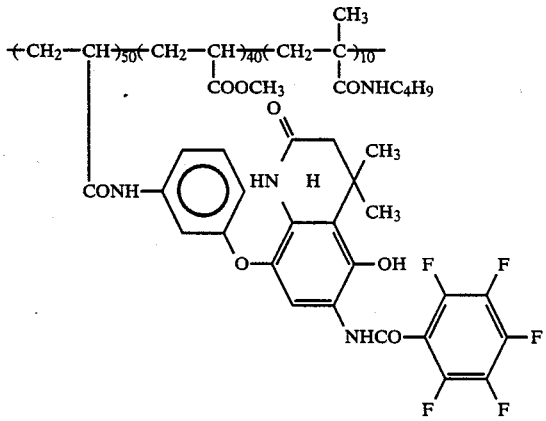
Subscripts 50, 40, and 10 represent the weight ratio of units in a polymer. These units may be present randomly.
(C-44)
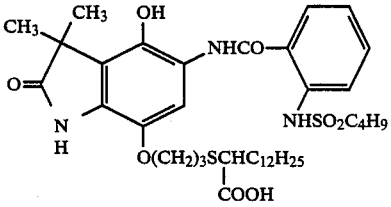
(C-45)
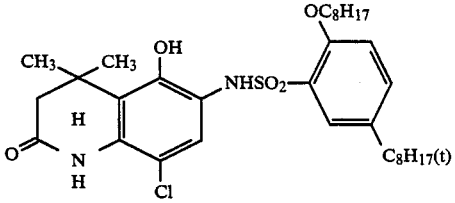

-continued
(C-46)
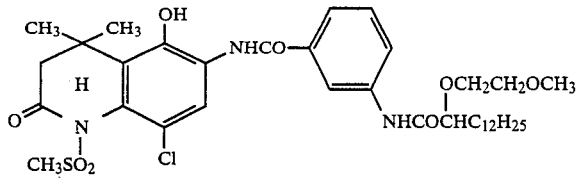
(C-47)
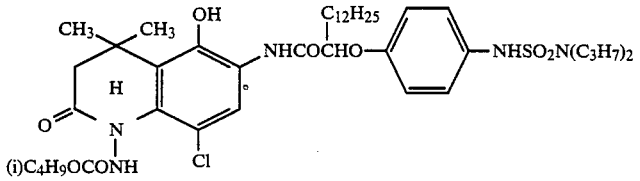
(C-48)
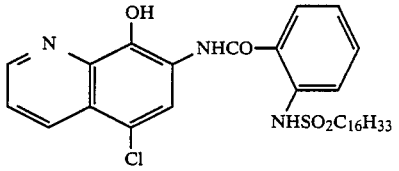
(C-49)
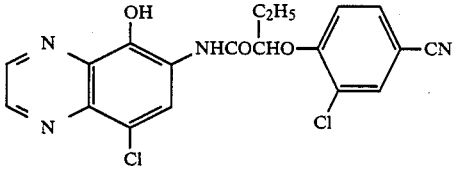
(C-50)
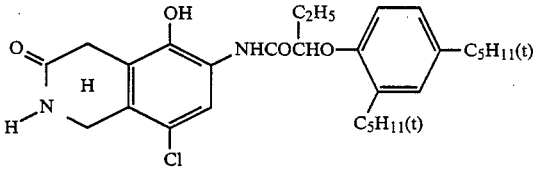
(C-51)
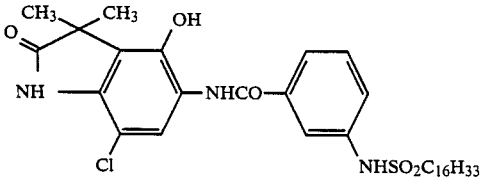
(C-52)
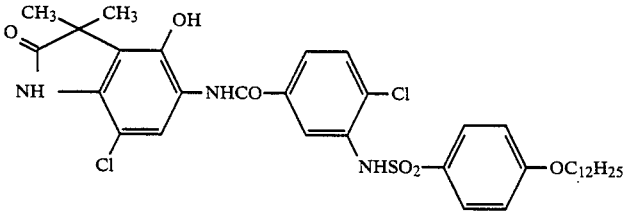

-continued (C-53)

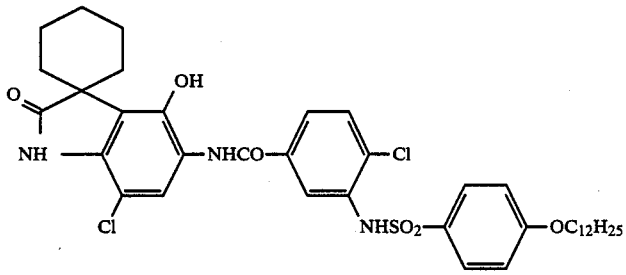

Cyan couplers represented by the general formula (I) according to the present invention can be synthesized, for example, in accordance with the processes described in U.S. Pat. Nos. 4,327,173, 4,430,423 and 4,564,586.

SYNTHESIS EXAMPLE

Synthesis of 6-[2-(2,4-di-tert-amylphenoxy)butanamido]-5-hydroxy-3,4-dihydrocarbostyril, Exemplified Coupler (1)

(i) Synthesis of 5-hydroxy-6-nitoro-3,4-dihydrocarbostyril 25 g of 5-hydroxy-3,4-dihydrocarbostyril were dissolved in 110 ml of acetic anhydride, and a mixture of 12 g of fuming nitric acid and 75 ml of acetic acid was added thereto dropwise at 5° C. After stirring for 2 hours at 5° C., 20 g of ice were added, and the precipitated crystals were filtered. The crystals were suspended in a 3N sodium hydroxide solution and then were filtered. The filtrate was neutralized with hydrochloric acid and the crystals that precipitated from the filtrate were filtered and washed with water. After drying the crystals, 22 g of the title product were obtained.

(ii) Synthesis of 6-[2-(2,4-di-tert-amylphenoxy)-butanamido]-5-hydroxy-3,4-dihydrocarbostyril 100 ml of acetone and 16.3 ml of triethylamine were added to 22 g of 5-hydroxy-6-nitro-3,4-dihydrocarbostyril obtained above, and 37.7 g of 2-(2,4-di-tert-amylphenoxy)butanoyl chloride were added thereto at normal temperatures. After stirring for 1 hour at room temperature, 100 ml of ethyl acetate were added, and the precipitated triethylamine hydrochloride was filtered and removed. The filtrate was condensed (i.e., the solvents were evaporated to reduce the volume of filtrate) under reduced pressure and crystallization from hexane produced 34 g of crystals (m.p.: 101°-105° C.). 150 ml of acetic acid, 70 ml of ethanol and 30 ml of water were added to the crystals, and 32 g of reduced iron were added portionwise thereto under reflux. After 1 hour under reflux, the mixture was poured into water, and was extracted with ethyl acetate. The extract was washed with water, the ethyl acetate was removed under reduced pressure, and crystallization from acetonitrile produced 26 g of the title coupler (m.p.: 203°-205° C.).

| Analysis (%) | C | H | N |
|---|---|---|---|
| Found | 72.45 | 8.45 | 5.65 |
| Calculated | 72.47 | 8.39 | 5.83 |

The development accelerators represented by the general formulae (II) to (VIII) are described in detail below.

In general formula (II), A preferably represents an electron accepting group represented by

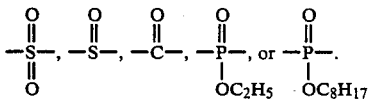

With respect to $R_1$ to $R_{10}$, $Y_1$, $R_a$ and $R_b$ in the above-described formulae (II) to (VIII), the aliphatic group includes a linear or branched alkyl group, an aralkyl group, an alkenyl group, an alkynyl group, a cycloalkyl group, a cycloalkenyl group, etc.; the aryl group includes, for example, a phenyl group, a 4-t-butylphenyl group, a 2,4-di-t-amylphenyl group, a naphthyl group, etc.; the alkoxy group includes, for example, a methoxy group, an ethoxy group, a benzyloxy group, a hexadecyloxy group, an octadecyloxy group, etc.; the aryloxy group includes, for example, a phenoxy group, a 2-methylphenoxy group, a naphthoxy group, etc.; the alkylamino group includes, for example, a methylamino group, a butylamino group, an octylamino group, etc.; the anilino group includes, for example, a phenylamino group, a 2-chloroanilino group, a 3-dodecyloxycarbonylanilino group, etc.; the alkylene group includes, for example, a methylene group, an ethylene group, a decylene group, a group containing a hetero atom such as $-CH_2CH_2OCH_2CH_2-$, etc.; the arylene group includes, for example, a 1,4-phenylene group, a 1,3-phenylene group, a 1,4-naphthylene group, a 1,5-naphthylene group, etc.; the aralkylene group includes, for example,

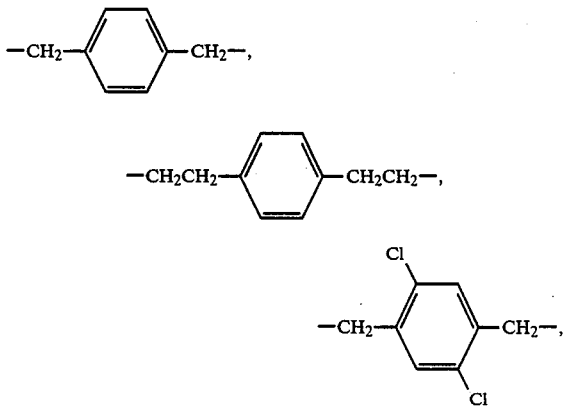

etc.; and the heterocyclic group may, for example, be a 5-to 10-membered, saturated or unsaturated, ring or fused ring system containing from 1 to 3 hetero atoms selected from the group consisting of nitrogen, oxygen, and sulfur, and includes, for example, a pyrazolyl group, an imidazolyl group, a triazolyl group, a pyridyl group, a quinolyl group, a piperidyl group, a triazinyl group, etc.

With respect to $R_1$ to $R_{10}$, $Y_1$, $R_a$ and $R_b$ in the above-described formulae (II) to (VIII), substituents in the substituted alkyl group, substituted aryl group, substituted alkoxy group, substituted aryloxy group, substituted alkylamino group, substituted anilino group, substituted alkylene group, substituted arylene group, substituted aralkylene group, substituted heterocyclic group, substituted amino group, substituted alkylsulfonyl group, substituted phenylsulfonyl group, and substituted acylsulfonyl group include, for example, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, and an aryloxycarbonyl group.

In the general formula (VII), the heterocyclic group represented by

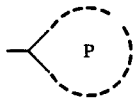

is the same as the heterocyclic group mentioned above and may have the same substituents as mentioned above with respect to substituents of $R_1$ to $R_{10}$, $Y_1$, $R_a$ and $R_b$ above.

Of compounds represented by the general formulae (II) to (VIII), preferable ones are those represented by the general formulae (II), (IV) and (V) and more preferably by the general formula (II).

Of compounds represented by the general formula (II), particularly preferable ones are those wherein A represents

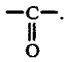

Compounds represented by the general formulae (II) to (VIII) can be introduced into a photosensitive material by the oil-in-water dispersing method and although the compounds may be dispersed singly or may be dispersed together with other photosensitive material components, the compounds preferably are dispersed together with an oil-soluble coupler.

Although compounds represented by the general formula (II) to (VIII) may be added in an arbitrary amount, preferably the amount to be added is 20 to 300 mol %, more preferably 40 to 150 mol % relative to the number of mols of an oil-soluble coupler that is dispersed together with the compound.

The Compounds represented by the general formulae (II) to (VIII) can be synthesized by the method described, for example, in U.S. Pat. Nos. 4,207,393, 4,363,873, 4,430,422, and 4,464,464 or other well known methods in the art.

Specific examples of compounds represented by the general formulae (II) to (VIII) are given below, which should not be construed to in any way limit the scope of the present invention.

(II-1)

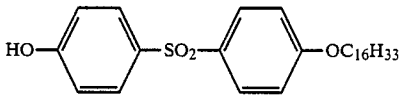

(II-2)

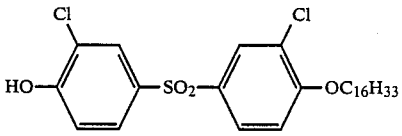

(II-3)

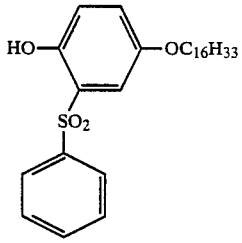

(II-4)

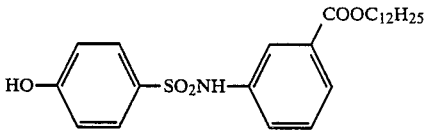

-continued
(II-5)
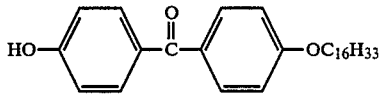
(II-6)
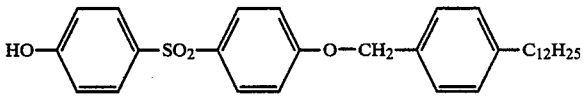
(II-7)
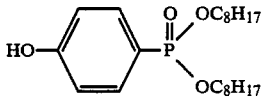
(II-8)
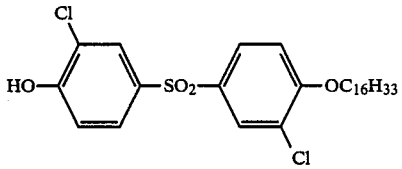
(II-9)
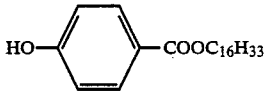
(II-10)
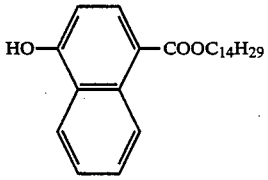
(II-11)
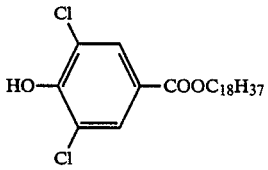
(II-12)
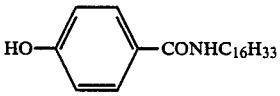
(II-13)
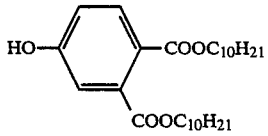
(III-1)
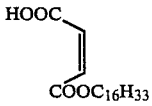
(III-2)
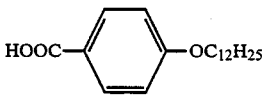

-continued
(III-3)
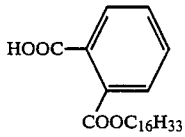
(III-4)
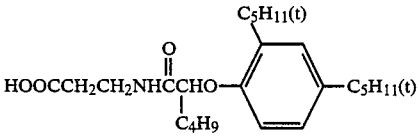
(III-5)
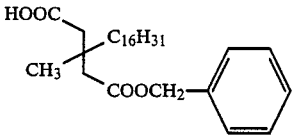
(IV-1)
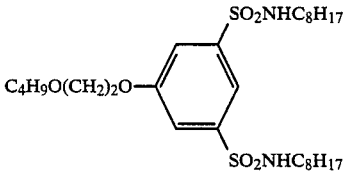
(IV-2)
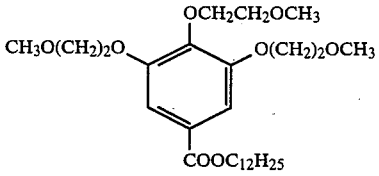
(IV-3)
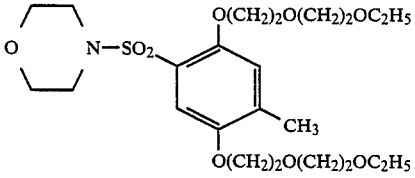
(IV-4)
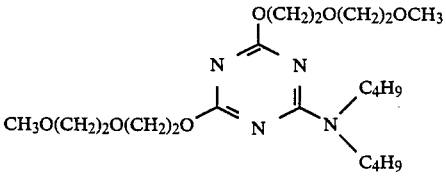
$(C_4H_9OCH_2CH_2O)_3P{=}O$ (IV-5)
(V-1)
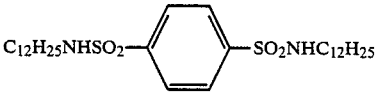
(V-2)
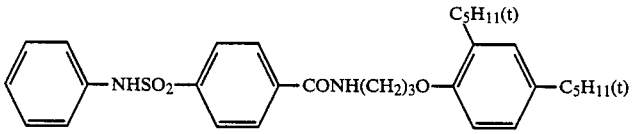

-continued
(V-3)
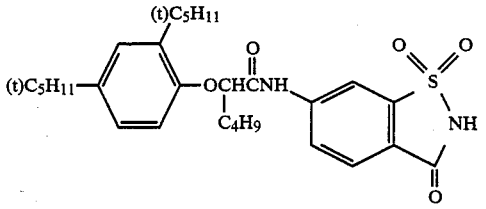
(V-4)
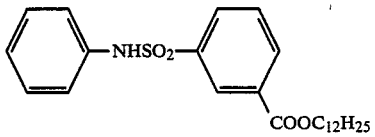
(V-5)
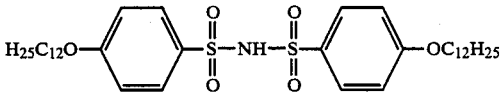
(VI-1)
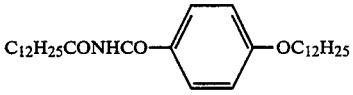
(VI-2)
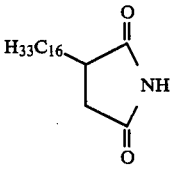
(VI-3)
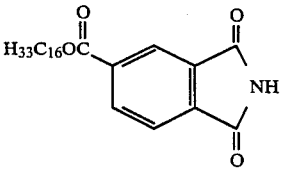
(VI-4)
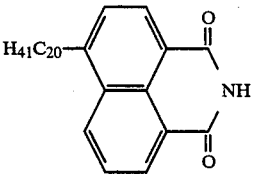
(VI-5)
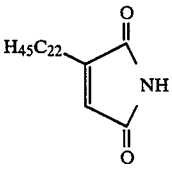
(VII-1)
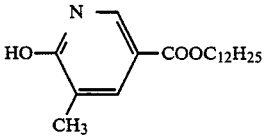

-continued

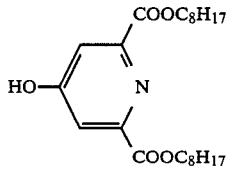

(VII-2)

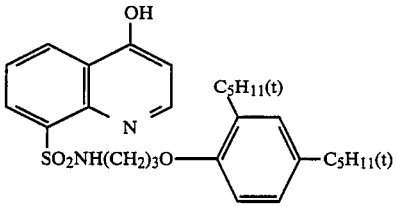

(VII-3)

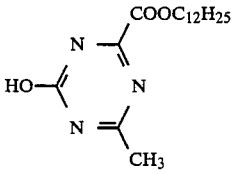

(VII-4)

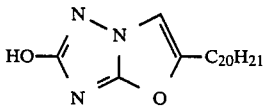

(VII-5)

$C_{18}H_{37}OH$ (VIII-1)

$C_{12}H_{25}OH$ (VIII-2)

$C_{10}H_{21}O(CH_2)_5O(CH_2)_2OH$ (VIII-3)

(VIII-4)

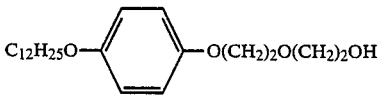

(VIII-5)

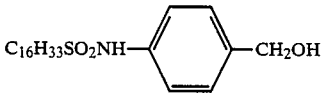

(VIII-6)

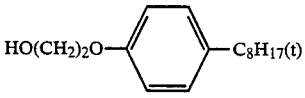

Various color couplers can be used in the present invention.

As yellow couplers which can be used in the present invention, acylacetamide based couplers such as benzoylacetanilide and pivaloyl acetanilide are preferred.

Of these couplers, compounds represented by the following formula (Y-1) or (Y-2) are particularly preferred.

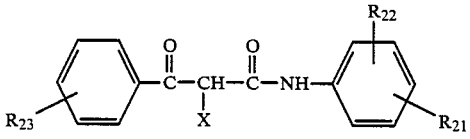

(Y-1)

-continued

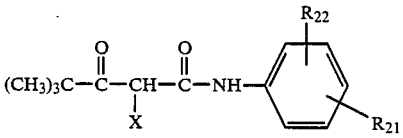

(Y-2)

wherein, X represents a hydrogen atom, or a coupling off group, $R_{21}$ represents a non-diffusible group having 8 to 32 carbon atoms, $R_{22}$ represents a hydrogen atom, one or more halogen atoms, a lower alkyl group, a lower alkoxy group, or a non-diffusible group having 8 to 32 carbon atoms, and $R_{23}$ represents a hydrogen atom or a substituent group, and when $R_{23}$ is two or more, they may be the same or different.

Detailed description of the pivaloyl acetanilide type yellow couplers is described in U.S. Pat. No. 4,622,287, col. 3, line 15–col. 8, line 39, and U.S. Pat. No.

4,623,616, col. 14, line 50–col. 19, line 41. Detailed description of the benzoyl acetanilide type yellow couplers is described in U.S. Pat. Nos. 3,408,194, 3,933,501, 4,046,575, 4,133,958, 4,401,752, etc.

Typical examples of the pivaloylacetanilide type yellow couplers are shown in U.S. Pat. No. 4,622,287, col. 37–col. 54, as Exemplified Compounds (Y-1) to (Y-39). In the exemplified compounds, (Y-1), (Y-4), (Y-6), (Y-7), (Y-15), (Y-21), (Y-22), (Y-23), (Y-26), (Y-35), (Y-36), (Y-37), (Y-38), and (Y-39), etc. are particularly preferred.

Further, typical examples of the pivaloyl acetanilide type yellow couplers are shown in U.S. Pat. No. 4,623,613, col. 19–col. 24, as Exemplified Compounds (Y-1) to (Y-33). In the compounds, (Y-2), (Y-7), (Y-8), (Y-12), (Y-20), (Y-21), (Y-23), and (Y-29), etc. are also particularly preferred.

As other preferable yellow couplers which can be used in the present invention, Exemplified Compound (34) described in U.S. Pat. No. 3,408,194, col. 6, Exemplified Compounds (16) and (19) described in U.S. Pat. No. 3,933,501, Exemplified Compound (9) described in U.S. Pat. No. 4,046,575, col. 7–col. 8, Exemplified Compound (1) described in U.S. Pat. No. 4,133,958, col. 5–col. 6, Exemplified Compound (1) described in U.S. Pat. No. 4,401,752, col. 5, and the following structural compounds are illustrative:

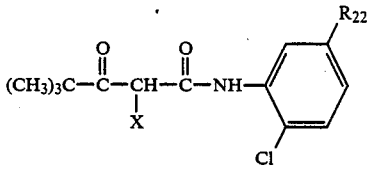

| Compound | $R_{22}$ | X |
|---|---|---|
| a | $-COOCH(CH_3)COOC_{12}H_{25}$ | 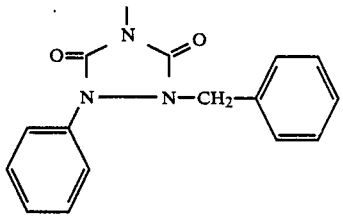 |
| b | $-COOCH(C_4H_9)COOC_{12}H_{25}$ | " |
| c | 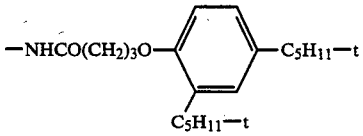 | 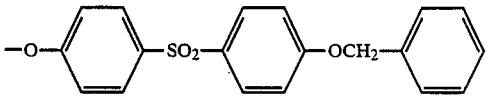 |
| d | " | 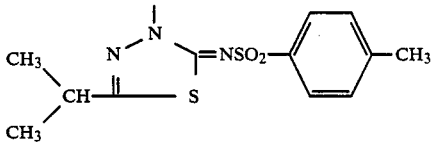 |
| e | " | 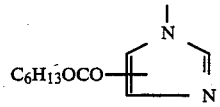 |
| f | $-NHSO_2C_{12}H_{25}$ | 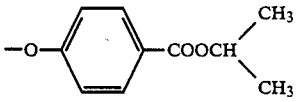 |
| g | $-NHSO_2C_{16}H_{33}$ | 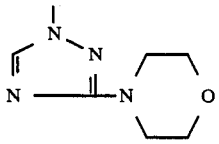 |

Of these yellow couplers, the coupling off group which is connected through a nitrogen atom is especially preferred.

As magenta couplers which can be used in the present invention, couplers which are hydrophobic and have a ballast group, such as indazolone- or cuyanoacetylbased couplers, preferably 5-pyrazolone- and pyrazoloazole-based couplers such as pyrazolotriazoles, are typically used. 5-Pyrazolone-based couplers which are substituted with an arylamino group or acylamino group in the 3-position are preferred from the standpoints of the hue of the colored dye and color density. Typical examples are described in U.S. Pat. Nos. 2,311,082, 2,343,703, 2,600,788, 2,908,573, 3,062,653, 3,152,896 and 3,936,015. As releasing groups of 2-equivalent 5-pyrazolone-based couplers, nitrogen atom releasing groups as described in U.S. Pat. No. 4,310,619 and an arylthio group as described in U.S. Pat. No. 4,351,897 are particularly preferred. 5-Pyrazolone-based couplers having a ballast group as described in European Pat. No. 73,636 provide high color density. As pyrazoloazole-based couplers, pyrazolobenzimidazoles as described in U.S. Pat. No. 3,369,897, preferably pyrazolo[5,1-c][1,2,4]triazoles as described in U.S. Pat. No. 3,725,067, pyrazolotetrazoles as described in *Research Disclosure*, No. 24220 (June, 1984), and pyrazolopyrazoles as described in *Research Disclosure*, No. 24230 (June, 1984) are illustrative.

The above described magenta couplers may be polymer couplers.

Typical examples of the magenta couplers are the compounds represented by the following formula (M), (M') or (M''):

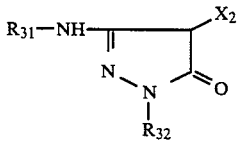

(M)

-continued

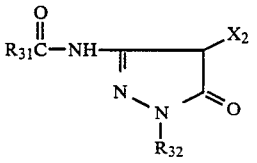

(M')

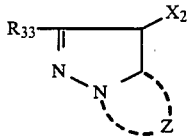

(M'')

wherein, $R_{31}$ represents a non-diffusible group having 8 to 32 total carbon atoms, $R_{32}$ represents a substituted or unsubstituted phenyl group, $R_{33}$ represents a hydrogen atom or a substituted group, Z represents a group of non-metallic atoms necessary for forming 5-membered azole ring, which may contain at least one substituent group (which includes a condensed ring), containing 2 to 4 nitrogen atoms, and $X_2$ represents a hydrogen atom or a coupling off group.

Detailed descriptions of the substituent groups for $R_{33}$ and azole ring of Z are described, for example, in U.S. Pat. No. 4,540,654, col. 2, line 4–col. 8, line 27. In view of the decreased yellow sub-absorption of the colored dye formed and light fastness, imidazo[1,2-b]pyrazoles as described in U.S. Pat. No. 4,500,630 are preferred, and pyrazolo[1,5-b][1,2,4]triaxzole are particularly preferred.

In addition, pyrazolotriazole couplers in which a branched alkyl group is bonded to the 2-, 3-, or 6-position of the pyrazolotriazole ring, as described in Japanese Patent Application (OPI) No. 65245/86, pyrazoloazole couplers having a sulfonamide group within the molecule, as described in Japanese Patent Application (OPI) No. 65246/86, pyrazoloazole couplers having alkoxyphenyl sulfonamide as a ballast group, as described in Japanese Patent Application (OPI) No. 147254/86, and pyrazolotriazole couplers having an alkoxy group in the 6-position as described in European patent application Ser. No. 226,849A are alos preferred.

Specific examples of the pyrazoloazole couplers are represented by the following formulae:

| Compound | $R_{33}$ | $R_{34}$ | $X_2$ |
|---|---|---|---|
| | | 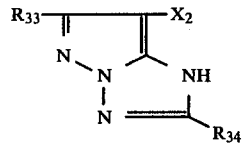 | |
| M-1 | $CH_3$— | 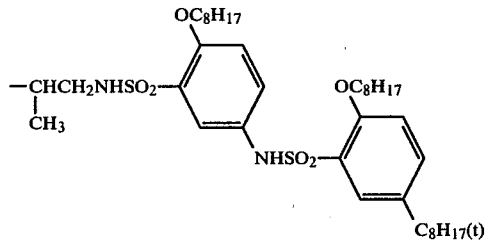 | Cl |
| M-2 | $CH_3$— | 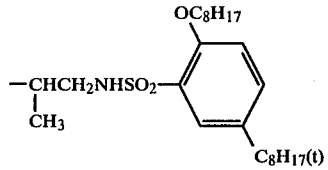 | Cl |
| M-3 | $CH_3$— | 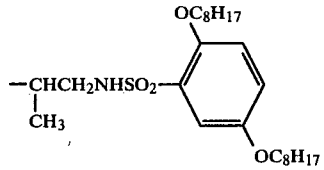 | 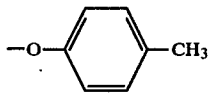 |
| M-4 | $CH_3$—NHCNH— (O) | 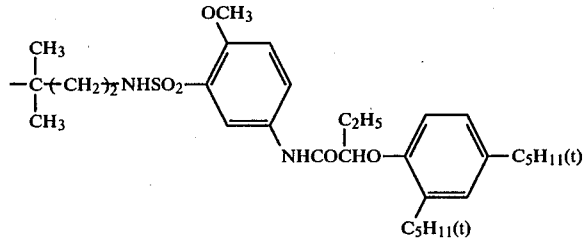 | 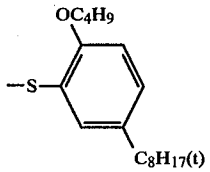 |

-continued
| Compound | $R_{33}$ | $R_{34}$ | $X_2$ |
|---|---|---|---|
| M-5 | $CH_3$— | 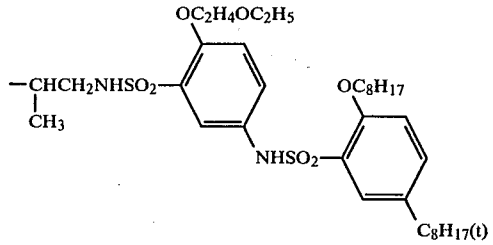 | Cl |
| M-6 | $CH_3$— | 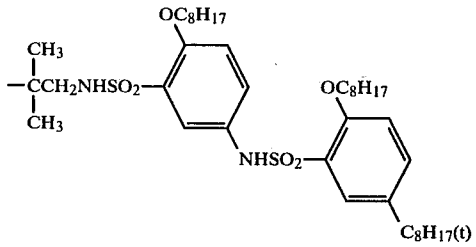 | Cl |
| M-7 | 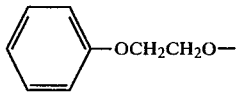 | 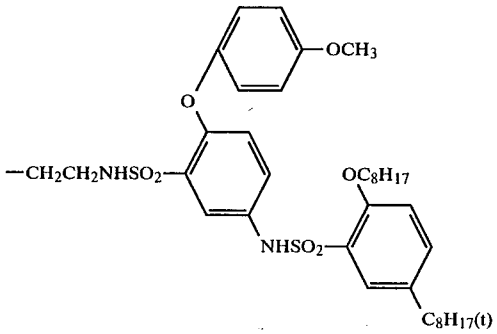 | 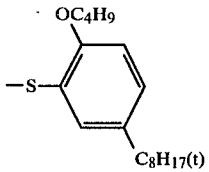 |

-continued
| Compound | $R_{33}$ | $R_{34}$ | $X_2$ |
|---|---|---|---|
| M-8 | $CH_3CH_2O-$ | 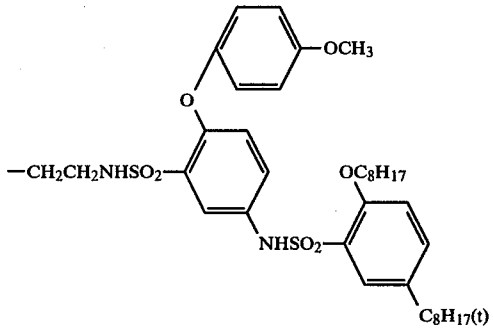 | 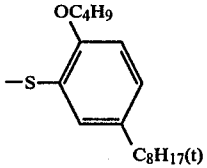 |
| M-9 | $CH_3CH_2O-$ | 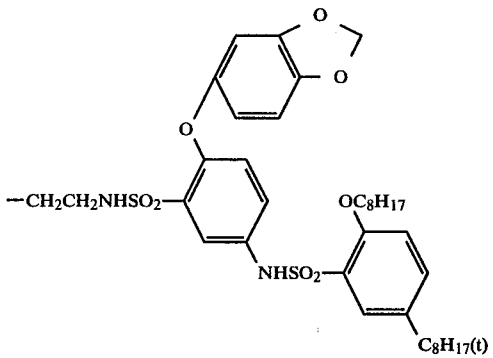 | 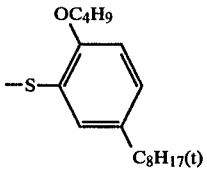 |
| M-10 | 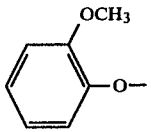 | 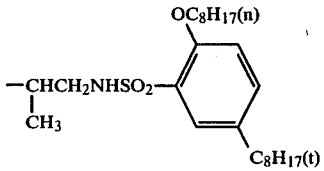 | Cl |
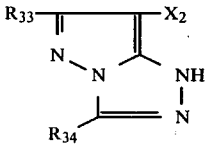

-continued
| Compound | $R_{33}$ | $R_{34}$ | $X_2$ |
|---|---|---|---|
| M-11 | $CH_3-$ | 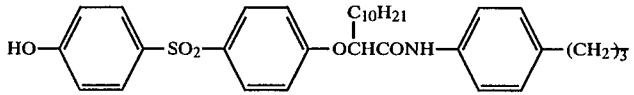 | Cl |
| M-12 | $CH_3-$ | 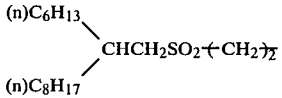 | Cl |
| M-13 | 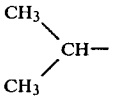 | 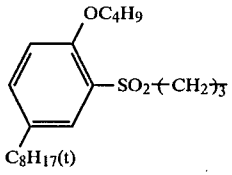 | Cl |
| M-14 | 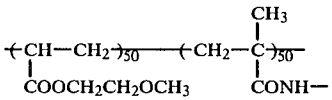 | 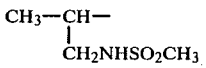 | Cl |
| M-15 | | 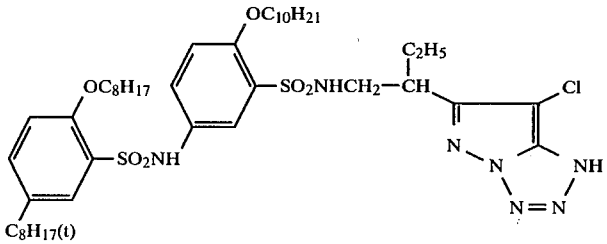 | |

Cyan couplers which can be used together with the cyan couplers represented by the formula (I) of the present invention include oil protect type naphthol-and-phenol-based couplers.

As the naphthol-based cyan couplers, those having an N-alkyl-N-arylcarbamoyl group at the 2-position of the naphthol-ring, as described in U.S. Pat. No. 2,313,586, those having an alkylcarbamoyl group at the 2-position, as described in U.S. Pat. Nos. 2,474,293 and 4,282,312, those having an arylcarbomoyl group at the 2-position, as described in Japanese Patent Application (OPI) No. 14523/75, those having a carbonamide or sulfonamide group at the 5-position, as described in Japanese Patent Application (OPI) Nos. 237448/85, 145557/86, and 153640/86, those having an aryloxy coupling off group as described in U.S. Pat. No. 3,476,563, those having a substituted alkoxy coupling off group as described in U.S. Pat. No. 4,296,199, those having glycolic acid coupling off group as described in Japanese Patent Publication No. 39217/85, etc. are exemplified.

Specific examples of the cyan couplers are Coupler (1) described in U.S. Pat. No. 2,474,293, Coupler (2) described in U.S. Pat. No. 3,476,563, Coupler (8) described in U.S. Pat. No. 4,296,199, Coupler (3) described in U.S. Pat. No. 4,282,312, Couplers (X) and (VIII) described in Japanese Patent Publication No. 14523/75, Couplers (1) and (9) described in Japanese Patent Publication No. 39217/85, Coupler (13) described in Japanese Patent Application (OPI) No. 5239/87, Couplers (1) and (3) described in Japanese Patent Application (OPI) No. 237448/85, Couplers (8) and (18) described in Japanese Patent Application (OPI) No. 153640/86, and couplers having the following structures:

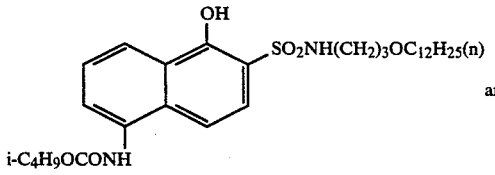

and

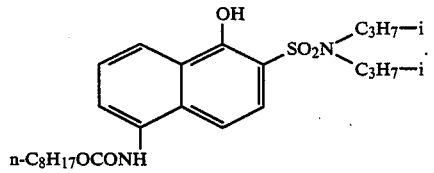

As the phenol-based cyan couplers, those (which include polymer couplers) having, in the phenol nucleus, an acylamino group at the 2-position and an alkyl group at the 5-position, as described in U.S. Pat. Nos. 2,369,929, 4,518,687, 4,511,647, and 3,772,002 are exemplified. Typical examples of those include the coupler described in Example 2 of Canadian Pat. No. 625,822, Compound (1) described in U.S. Pat. No. 3,772,002, Compounds (I-4) and (I-5) described in U.S. Pat. No. 4,564,590 Compounds (1), (2), (3), and (24) described in Japanese Patent Application (OPI) No. 39045/86, and Compound (C-2) described in Japanese Patent Application (OPI) No. 70846/87.

Further, 2,5-diacylaminophenol type couplers as described in U.S. Pat. Nos. 2,772,162, 2,895,826, 4,334,011, and 4,500,635 and Japanese Patent Applicaiton (OPI) No. 164555/84 are also exemplified as the phenol-based cyan couplers.

Typical examples of the 2,5-diacylaminophenol type couplers include Compound (V) described in U.S. Pat. No. 2,895,826, Compound (17) described in U.S. Pat. No. 4,557,999, Compounds (2) and (12) described in U.S. Pat. No. 4,565,777, Compound (4) described in U.S. Pat. No. 4,124,396, Compound (I-19) described in U.S. Pat. No. 4,613,564, etc.

Furthermore, ureido type couplers as described in U.S. Pat. Nos. 4,333,999, 4,451,559, 4,444,872, 4,427,767, and 4,579,813, and European Pat. No. 067,689B1are exemplified as the phenol-based cyan couplers which can be used in the present invention. Typical examples of the ureido type couplers include Coupler (7) described in U.S. Pat. No. 4,333,999, Coupler (1) described in U.S. Pat. No. 4,451,559, Coupler (14) described in U.S. Pat. No. 4,444,872, Coupler (3) described in U.S. Pat. No. 4,427,767, Couplers (6) and (24) described in U.S. Pat. No. 4,609,619, Couplers (1) and (11) described in U.S. Pat. No. 4,579,813, Couplers (45) and (50) described in European Pat. No. 067,689B1, and Coupler (3) described in Japanese Patent Application (OPI) No. 42658/86, etc.

The color photographic material may further contain a hydroquinone derivative, an aminophenol derivative, a gallic acid derivative, an ascorbic acid derivative, etc., as color fog preventing agents.

In addition, as dye image stabilizing agents, catechol derivatives as described, for example, in Japanese Patent Application (OPI) Nos. 125732/84 and 262159/85 can be used in the present invention.

The color photographic material in this invention may contain ultraviolet absorbent(s) in the hydrophilic colloid layer. Examples of the ultraviolet absorbent are aryl group-substituted benzotriazole compounds (e.g., those described in U.S. Pat. No. 3,533,794), 4-thiazolidone compounds (e.g., those described in U.S. Pat. Nos. 3,314,794, 3,352,681), benzophenone compounds (e.g., those described in Japanese Patent Application (OPI) No. 2784/71), cinnamic acid ester compounds (e.g., those described in U.S. Pat. Nos. 3,705,805, 3,707,375), butadiene compounds (e.g., those described in U.S. Pat. No. 4,045,229), and benzoxidole compounds (e.g., those described in U.S. Pat. No. 3,700,455). Furthermore, ultraviolet absorptive couplers (e.g., α-naphtholic cyan dye-forming couplers) or ultraviolet absorptive polymers may be used as ultraviolet absorbents. These ultraviolet absorbents may be mordanted and added to specific layers.

The color photographic materials for use in this invention may contain water-soluble dyes as filter dyes or for irradiation prevention or other various purposes in the hydrophilic colloid layers. Examples of such water-soluble dyes are oxonol dyes, hemioxonol dyes, styryl dyes, merocyanine dyes, cyanine dyes, and azo dyes. In these dyes, oxonol dyes, hemioxonol dyes, and merocyanine dyes are useful.

As the binder or protective colloids which can be used for the emulsion layers of the color photographic material for use in this invention, gelatin is advantageously used but other hydrophilic colloids can be used alone or together with gelatin.

As gelatin, limed gelatin or acid-treated gelatin can be used in this invention. Details of the production of gelatin are described in Arther Weiss, *The Macromolecular Chemistry of Gelatin*, published by Academic Press, 1964.

For the silver halide emulsion layers of the color photographic materials for use in this invention, silver bromide, silver iodobromide, silver, iodochlorobromide, silver chlorobromide, or silver chloride is used as the silver halide.

There is no particular restriction on the mean grain size (represented by the diameter of the grains when the grain is spherical or similar to spherical, and represented by the mean value based on the projected area using, in the case of cubic grains, the long side length as the grain size) of the silver halide grains in the photographic emulsions but it is preferred that the grain size be smaller than about 2 μm.

The grain size distribution may be narrow or broad, but a monodispersed silver halide emulsion having a coefficient of variation less than 15% is preferred.

The silver halide grains in the photographic emulsion layers may have a regular crystal form such as cubic, octahedral, etc., or an irregular crystal form such as ring, tabular, etc., or may have a composite form of these crystal forms. In these emulsions, the use of a photographic emulsion of regular crystal form is preferred.

Also, a silver halide emulsion wherein tabular silver halide grains having an aspect ratio (length/thickness) of at least 5 accounts for at least 50% of the total projected area of the silver halide grains may be used in this invention.

The silver halide grains for use in this invention may have a composition or structure inside the grain which is different from that on the surface layer thereof. Also, the silver halide grains may be of the type that latent images are formed mainly on the surface thereof or of the type that latent images are formed mainly in the inside thereof.

During the formation or physical ripening of the silver halide grains, a cadmium salt, a zinc salt, a thallium salt, an iridium salt or a complex salt thereof, a rhodium salt or a complex salt thereof, an iron salt or a complex salt thereof, etc., may exist in the system.

Silver halide emulsions are usually chemically sensitized.

The silver halide emulsions for use in this invention can further contain various kinds of compounds for preventing the occurrence of fog during the production, sotrage and/or processing of color photographic materials or for stabilizing photographic performance. Examples of such compounds include the compound known as antifoggants or stabilizers such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole, etc.), mercaptopyrimidines, mercaptotriazines, etc.; thioketo compounds such as oxazolinethione, etc.; azaindenes (e.g., triazaindenes, tetraazaindenes, in particular, 4-hydroxy-substituted (1,3,3a, 7)tetraazaindene), pentaazaindenes, etc.; benzenethiosulfonic acid, benzensulfinic acid, benzenesulfonic acid amide, etc.

The present invention can be applied to a multilayer multicolor photographic materials having at least two photopgraphic emulsion layers each having different spectral sensitivity on a support. A multilayer natural color photographic material usually has at least one red-sensitive emulsion layer, at least one green-sensitive emulsion layer and at least one blue-sensitive emulsion layer on a support. The disposition order of these photographic emulsion layers can be ooptionally selected according to the purpose for which the photographic material is used. Usually, a red-sensitive emulsion layer contains a cyan-forming coupler, a green-sensitive emulsion layer contains a magenta-forming coupler, and a blue-sensitive emulsion layer contains a yellow-forming coupler.

As the support for use in this invention, there are, for example, cellulose nitrate films, cellulose acetate films, cellulose acetate butyrate films, cellulose acetate propionate films, polystyrene films, polyethylene terephthalate films, polycarbonate films, laminates of these films, thin glass films, papers, etc. Paper coated with baryta or an α-olefin polymer, in particular, a polymer of an α-olefin having 2 to 10 carbon atoms, such as polyethylene, polypropylene, ethylene-butene copolymer, etc., and a support such as a plastic film, etc., having a roughened surface or improving the adhesion with other polymers as described in Japanese Patent Publication No. 19068/72 give good results. Also, a resin hardenable by the irradiation of ultraviolet rays can be used.

According to the purpose of the color photographic material, a transparent support or an opaque support may be used. Also, a colored transparent support containing dyes or pigments can also be used.

As an opaque support for use in this invention, there are papers which are opaque by themselves and transparent films which were opacified by the incorporation of dyes or pigments such as titanium oxide, etc. Also, a plastic film surface-treated by the method described in Japanese Patent Publication No. 19068/72 and further papers of plastic films rendered completely light shielding by the addition of carbon black, dyes, etc., can be used.

A subbing layer is usually formed on a support. Furthermore, for improving the adhesive property, a pretreatment such as corona discharging treatment, ultraviolet treatment, flame treatment, etc., may be applied to the surface of the support.

As a color photographic light-sensitive material which can be used for making the color photograph of this invention, an ordinary color photographic light-sensitive material, in particular, a color photographic light-sensitive material for color prints is preferred, and color photographic light-sensitive materials of color photographic systems (in particular, color diffusion transfer photographic systems) described in U.S. Pat. Nos. 3,227,550, 3,227,551, 3,227,552, and U.S. Temporary Published Patent B351,673, etc., may be used.

For obtaining dye images by a conventional photographic process, it is necessary to apply color photographic processing after imagewise exposure. Color photographic processing fundamentally includes the steps of color development, bleach and fix. In this case, two steps of bleach and fix may be performed by one step (bleach-fixing or blix).

Furthermore, a cmbination of color develpment, first fix, and blix can be employed in this invention. The color photographic process may include, if necessary, various steps of pre-hardening, neutralization, first development (black and white developement), image stabilization, wash, etc. The processing temperature is generally 18° C. or more, and preferably in the range from 20° C. to 60° C. In particular, recently the rane of from 30° C. to 60° C. is used.

A color developer is an aqueous alkaline solution containing an aromatic primary amino color developing agent having a pH of at least 8, preferably from 9 to 12.

After the fix or blix step, the "wash process" is usually performed, but a simple so-called "stabilization process" may be substituted in place of the wash process substantially without employing a wash step.

Preferred examples of the aromatic primary amino color developing agent are p-phenylenediamine derivatives and specific examples thereof are shown below, although the invention is not limited to them.

D-1: N,N-Diethyl-p-phenylenediamine
D-2: 2-Amino-5-diethylaminotoluene
D-3: 2-Amino-5-(N-ethyl-N-laurylamino)toluene
D-4: 4-(N-Ethyl-N-(β-hydroxyethyl)amino)aniline
D-5: 2-Methyl-4-[4-N-ethyl-N-(β-hydroxyethyl-)amino]aniline
D-6: N-Ethyl-N-(β-methanesulfonamidoethyl)-3-methyl-4-aminoaniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Also, these p-phenylenediamine derivatives may be in the form of salts thereof, such as sulfates, hydrochlorides, sulfites, p-toluenesulfonates, etc. The aforesaid compounds are described in U.S. Pat. Nos. 2,193,015, 2,552,241, 2,566,271, 2,592,364, 3,656,950, 3,698,525, etc. The amount of the aromatic primary amine color developing agent is from about 0.1 g to about 20 g, and preferably from about 0.5 g to about 10 g per liter of color developer.

The processing temperature fo the color developer is preferably from 30° C. to 50° C., and more preferably from 33° C. to 42° C. Also, the amount of a replenisher for the color developer is from 30 ml to 2,000 ml, and preferably from 30 ml to 1,500 ml per square meter of color photographic material. The amount of the replenisher is, however, preferably as low as possible from the viewpoint of reducing the amount of waste liquid.

Also, when benzyl alcohol exists in the color developer, the amount thereof is preferably less than 2.0 ml/liter, and more preferably less than 0.5 ml/liter. A color developer containing no benzyl alcohol is most preferred. The time for color development is preferably within 2 minutes and 30 seconds, more preferably from 10 seconds to 2 minutes and 30 seconds, and most preferably from 45 seconds to 2 minutes.

The invention now will be explained with reference to the following Examples. Unless otherwise stated herein, all ratios, parts, percentages, and the like are by weight.

EXAMPLE 1

On paper supports coated with a polyethylene, the following layers were applied successively to prepare 8 types of silver halide photographic materials. The coating liquid was prepared as described below.

First layer: preparation of the Coating Liquid 20.1 g of Cyan Coupler (C-23) according to the present invention, 27.2 ml of ethyl acetate and 7.9 ml of a solvent (*) were warmed with stirring to obtain a solution, and the solution was emulsified and dispersed into 185 ml of a 10% aqueous gelatin solution containing 8 ml of 10% sodium dodecylbenzenesulfonate. On the other hand, to a silver chlorobromide emulsion (containing 80 mol % of silver bromide and 70 g of Ag/kg) was added a red-sensitive sensitizing dye shown below in an amount of $7.0 \times 10^{-4}$ mol per mol of silver chlorobromide to prepare 90 g of a red-sensitive emulsion. The emulsified dispersion and the emulsion were mixed, and the concentration of gelatin was adjusted to produce a composition as shown below so that a first layer coating liquid was prepared.

The composition of the first layer;

| | |
|---|---|
| Silver chlorobromide emulsion (in terms of applied silver) | 0.30 g/m$^2$ |
| Gelatin | 1.86 g/m$^2$ |
| Cyan Coupler (C-23) | 0.86 g/m$^2$ |
| Solvent (*) | 0.34 g/m$^2$ |

Solvent(*)

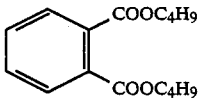

Red sensitive sensitizing dye

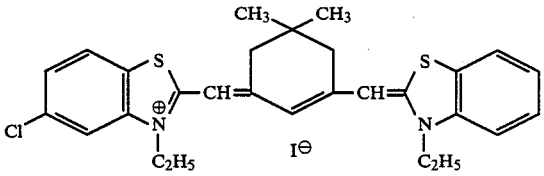

Second Layer

| | |
|---|---|
| Gelatin | 1.33 g/m$^2$ |

1-Hydroxy-3,5-dichloro-s-triazine sodium salt was used as a gelatin hardener for each layer.

The thus obtained color print maaterial was named Sample A.

Then each of exemplified compounds of the general formulae (II) to (VIII) according to the present invention was added to the first layer in an amount of 60 mol % relative to the number of mols of the coupler and, with other compositions (other than compounds of general formulae (II) to (VIII)) remaining the same, the same procedure as used for Sample A was followed to prepare color print materials, Samples B to H. To prepare color print materials, Samples I to P, instead of cyan coupler of the color print material, Sample A, the cyan couplers of the general formula (I) were used to prepare emulsions with and without the compound represented by (II-9) added in an amount of 60 mol % relative to the number of mols of each coupler according to the procedure used to prepare Samples A to H above using the same compositions (other than the cyan coupler and Compound (II-9)) as before.

As comparative color print materials, the following color print materials, Samples Q and R were prepared. In the color print material, Sample Q, instead of cyan coupler (C-23) in the print material, Sample A, Comparative Coupler (a) was used in the same amount. In the color print material, Sample R, Comparative Coupler (a) and the compound represented by (II-9), in an amount of 60 mole % relative to the number of mols of Comparative coupler (a), were used. The compositions of those color print materials, Samples A to R are shown in Table 1.

Comparative coupler (a)

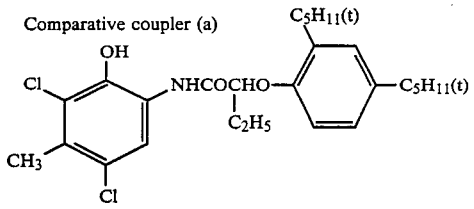

These samples were subjected to gradation exposure for sensitometry through a red filter by using a sensitometer (FWH type manufactured by Fuji Photo Film Co., Ltd.; the color temperature of the light source: 3,200° K.). The exposure was carried out such that the exposure time was 0.5 sec and the amount of exposure was 250 CMS.

The treatments included color development, bleach-fixing, and washing, and after these treatments, the photographic characteristics were evaluated.

The evaluation of the photographic characteristics included relative sensitivity and the maximum density ($D_{max}$).

| Treatment | Temperature | Time |
|---|---|---|
| Developing solution | 38° C. | 2.0 min |
| Bleach-fixing bath | 33° C. | 1.5 min |
| Washing | 28–35° C. | 3.0 min |

Formulation of color developing solution

| | |
|---|---|
| Diethylenetriaminetetraacetate.5Na | 2.0 g |
| $Na_2SO_3$ | 2.0 g |
| KBr | 0.5 g |
| Hydroxylamine sulfate | 3.0 g |
| 4-amino-3-methyl-N—ethyl-N—[β-(methanesulfonamido)ethyl]-p-phenylenediamine.sulfate | 5.0 g |
| $Na_2CO_3$ (monohydrate) | 30.0 g |
| Fluorescent whitening agent (stilbene type) | 1.0 g |

-continued

| | |
|---|---|
| Water to make (pH:10.1) | 1,000 ml |

Formulation of bleach-fixing bath

| | |
|---|---|
| Ammonium thiosulfate (54 wt %) | 150 ml |
| $Na_2SO_3$ | 15 g |
| $NH_4$[Fe(III)(EDTA)] | 55 g |
| EDTA.2Na | 4 g |
| Water to make (pH:6.9) | 1000 ml |

The reflection density of the samples obtained was measured using blue monochromatic light, and the results from the characteristic curves are shown in Table 1.

TABLE 1

| Color Print Sample | Cyan Coupler | Color Development Accelerator | Relative Sensitivity | $D_{max}$ | Remarks |
|---|---|---|---|---|---|
| A | C-23 | — | 100 | 1.55 | Comparative Example |
| B | C-23 | II-1 | 135 | 2.38 | According to the Invention |
| C | C-23 | III-2 | 131 | 2.35 | According to the Invention |
| D | C-23 | IV-2 | 133 | 2.36 | According to the Invention |
| E | C-23 | V-4 | 136 | 2.40 | According to the Invention |
| F | C-23 | VI-3 | 125 | 2.20 | According to the Invention |
| G | C-23 | VII-2 | 128 | 2.19 | According to the Invention |
| H | C-23 | VIII-1 | 130 | 2.30 | According to the Invention |
| I | C-1 | — | 110 | 1.76 | Comparative Example |
| J | C-1 | II-9 | 136 | 2.40 | According to the Invention |
| K | C-7 | — | 115 | 1.79 | Comparative Example |
| L | C-7 | II-9 | 138 | 2.42 | According to the Invention |
| M | C-24 | — | 117 | 1.78 | Comparative Example |
| N | C-24 | II-9 | 135 | 2.39 | According to the Invention |
| O | C-31 | — | 114 | 1.68 | Comparative Example |
| P | C-31 | II-9 | 133 | 2.36 | According to the Invention |
| Q | Comparative Coupler (a) | — | 105 | 1.67 | Comparative Example |
| R | Comparative Coupler (a) | II-9 | 115 | 1.99 | Comparative Example |

The relative sensitivity is a relative value, assuming the sensitivity of Sample A to be 100. The sensitivity is expressed by the relative value of the reciprocal of the amount of exposure required to give a density equivalent to the minimum density ($D_{max}$) plus 0.5.

From these results, it can be understood that the ability to increase the density and $D_{max}$ is remarkable when a condensed ring type coupler according to the present invention is combined with a color development accelerator according to the present invention. Although an effect by the color development accelerator on phenol type cyan couplers outside the present invention is discernible (Samples Q and R), the effect is not as great as that obtained with the condensed ring type cyan couplers of the present invention.

EXAMPLE 2

A multilayer color print paper having a layer construction as shown in Table 2 was formed on a paper support coated with a polyethylene. The coating liquid was prepared in the same manner as the first layer coating liquid in Example 1.

The color print material obtained thus was named Sample S.

The following were used as spectral sensitizing agents for the emulsions.

Blue-Sensitive Emulsion Layer

-continued

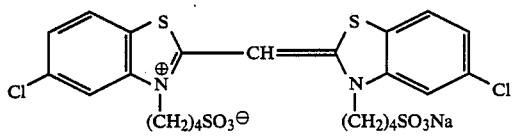

(Added amount was $7.0 \times 10^{-4}$ mol per mol of silver halide)

Green-Sensitive Emulsion Layer

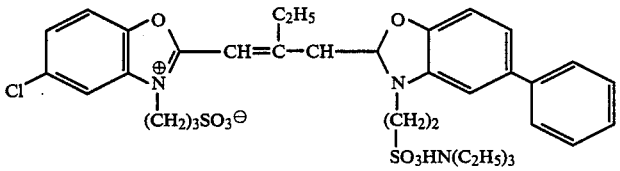

(Added amount was $4.0 \times 10^{-4}$ mol per mol of silver halide)

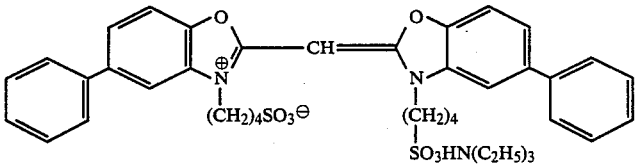

(Added amount was $7.0 \times 10^{-5}$ mol per mol of silver halide)

Red Sensitive Emulsion Layer

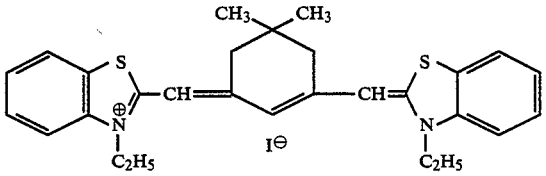

(Added amount was $1.0 \times 10^{-4}$ mol per mol of silver halide)

The following dyes were used as irradiation preventive dyes for the respective emulsion layers.

Green Sensitive Emulsion Layer

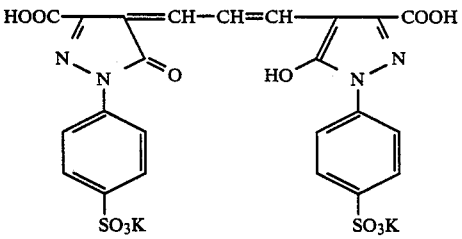

Red Sensitive Emulsion Layer

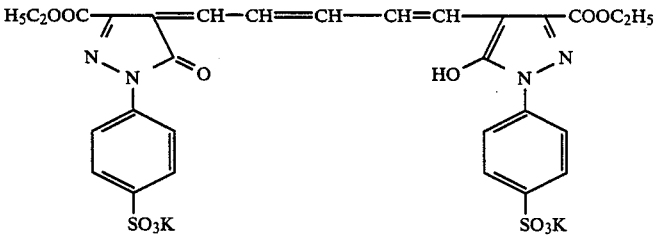

The structural formulae of various compounds used in the various layers are as follows.

(a) Color Image Stabilizer

-continued
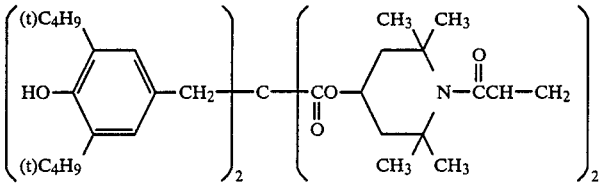
(b) Solvent
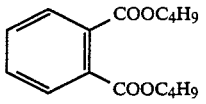
(c) Color Stain Preventing Agent
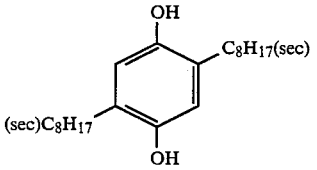
(d) Color Image Stabilizer
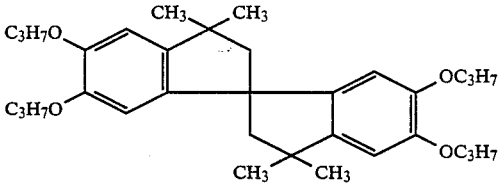
(e) Solvent
A mixture of $(C_8H_{17}O)_3P{=}O$ and
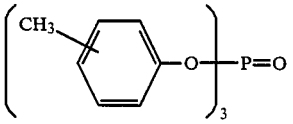
in a weight ratio of 2:1.
(f) Ultraviolet Absorber
A mixture of
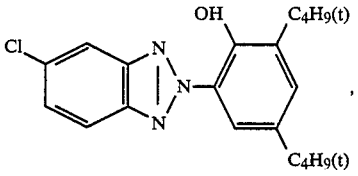
,
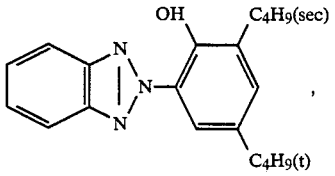
,
and
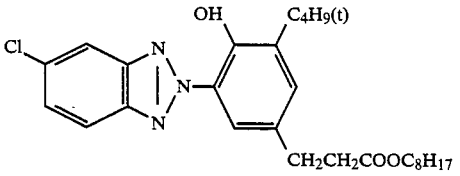
in a molar ratio of 1:5:3.
(g) Color Stain Preventing Agent -continued
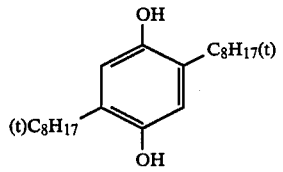
(h) Solvent
$(iso\text{-}C_9H_{18}O)_3P{=}O$
(i) Color Image Stabilizer
A mixture of
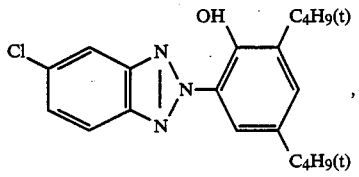
(i1)
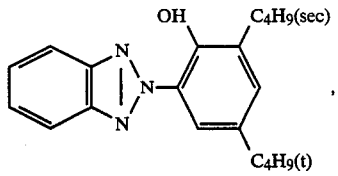
(i2)
and
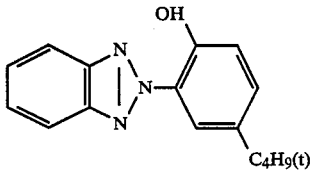
(i3)
in a molar ratio of 1:3:3.
(j) Solvent
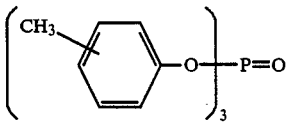
Magenta Coupler (M)
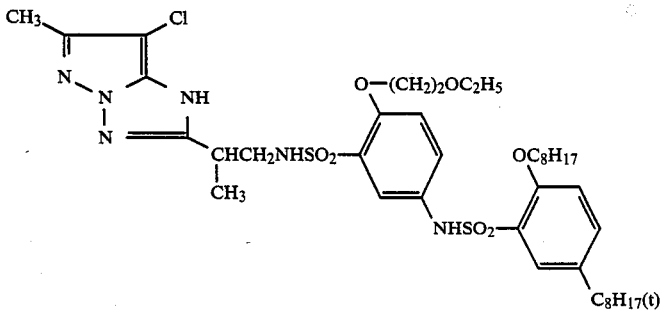
Yellow Coupler (Y)

-continued

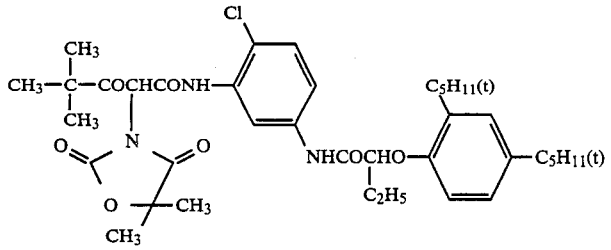

TABLE 2

| Layer | Support | Amount Used |
|---|---|---|
| Seventh Layer (Protective Layer) | Gelatin | 1.33 g/m$^2$ |
| | Acryl-modified polyvinyl alcohol (degree of modification: 17%) | 0.17 g/m$^2$ |
| Sixth Layer (ultraviolet absorbing layer) | Gelatin | 0.54 g/m$^2$ |
| | Ultraviolet absorbing Agent (f) | 0.21 g/m$^2$ |
| | Solvent (h) | 0.08 cc/m$^2$ |
| First Layer (red-sensitive layer) | Silver chlorobromide emulsion (silver bromide: 1 mol %) silver: | 0.22 g/m$^2$ |
| | Gelatin | 0.90 g/m$^2$ |
| | Cyan coupler (C-2) | 0.49 g/m$^2$ |
| | Color image stabilizer (i) | 0.17 g/m$^2$ |
| | Solvent (j) | 0.27 cc/m$^2$ |
| Fourth Layer (ultraviolet absorbing layer) | Gelatin | 1.60 g/m$^2$ |
| | Ultraviolet absorber (f) | 0.62 g/m$^2$ |
| | Color stain preventing agent (g) | 0.05 g/m$^2$ |
| | Solvent (h) | 0.26 cc/m$^2$ |
| Third Layer (green-sensitive layer) | Silver chlorobromide emulsion (silver bromide: 1 mol %) silver: | 0.15 g/m$^2$ |
| | Gelatin | 1.56 g/m$^2$ |
| | Magenta coupler (M) | 0.33 g/m$^2$ |
| | Color image stabilizer (d) | 0.20 g/m$^2$ |
| | Solvent (e) | 0.68 cc/m$^2$ |
| Second layer (color stain preventing layer) | Gelatin | 0.99 g/m$^2$ |
| | Color stain preventing agent (c) | 0.08 g/m$^2$ |
| First layer (blue-sensitive layer) | Silver chlorobromide emulsion (silver bromide: 2 mol %) silver: | 0.35 g/m$^2$ |
| | Gelatin | 1.35 g/m$^2$ |
| | Yellow coupler (Y) | 0.90 m$^2$ |
| | Color image stabilizer (a) | 0.13 g/m$^2$ |
| | Solvent (b) | 0.02 cc/m$^2$ |
| Support | Polyethylene laminated paper (the poly-ethylene on the first layer contained white pigment ($TiO_2$) and blueish dye (ultra-marine)) | |

Then, the exemplified compound (II-9) according to the present invention in an amount of 60 mol % relative to the number of mols of the coupler was added to the first, third and fifth layers, and with the same composition as before, the same procedure as before was repeated to produce a color print material, Sample T.

These samples were subjected to gradation exposure for sensitometry through red, green and blue filters by using a sensitometer (FWH type, manufactured by Fuji Photo Film Co., Ltd.; the temperature of the light source: 3,200° K.). The exposure was carried out such that the exposure time was 0.5 sec and the amount of exposure was 250 CMS.

Thereafter, the samples were treated with the developing solution shown below. The results obtained are given in Table 3. In Table 3, B, G and R are values of densities obtained by blue, green and red monochromatic light, relative sensitivity was measured by the method defined in Example 1, assuming the relative density of R of Sample S to be 100.

| Step | Temperature | Time |
|---|---|---|
| Color development | 35° C. | 45 sec |
| Bleach-fixing bath | 35° C. | 45 sec |
| Rinsing (1) | 30° C. | 20 sec |
| Rinsing (2) | 30° C. | 20 sec |
| Rinsing (3) | 30° C. | 20 sec |
| Rinsing (4) | 30° C. | 20 sec |
| Drying | 70° C. | 1 min |

The formulations of the treating liquids used were as follows:

| | |
|---|---|
| Color developing solution (B) | |
| Triethanolamine | 8.12 g |
| 4,4'-diaminostilbene type fluorescent whitening agent (Whitex 4 manufactured by Sumitomo Chemical Co., Ltd.) | 2.81 g |
| N,N—diethylhydroxylamine (85%) | 4.93 g |
| NaCl | 1.36 g |
| Sodium sulfite | 0.13 g |
| N—ethyl-N—(β-methanesulfonamido-ethyl)-3-methyl-4-aminoaniline sulfate | 4.96 g |
| $K_2CO_3$ | 18.4 g |
| $KHCO_3$ | 4.85 g |
| EDTA.2Na.2$H_2O$ | 2.2 g |
| Water to make (pH was adjusted to 10.05 with KOH) | 1,000 ml |
| Bleach-fixing bath (B) | |
| EDTA.Fe(III)$NH_4$.2$H_2O$ | 54.1 g |
| EDTA.2Na.2$H_2O$ | 3.41 g |
| Ammonoium Thiosulfate (70%) | 103 ml |
| $Na_2SO_3$ | 16.71 g |
| Glacial acetic acid | 8.55 g |
| Water to make (pH:5.7) | 1,000 ml |
| Rinsing liquid | |
| Benzotriazol | 1.0 g |
| Ethylenediaminetetra-methylenephosphonic acid | 0.5 g |
| Water to make (pH was adjusted to 7.5 with KOH) | 1,000 ml |

TABLE 3

| Sample | Monochromatic Light | Relative Sensitivity | $D_{max}$ | Remarks |
|---|---|---|---|---|
| S | B | 113 | 2.21 | Comparative Example |
| S | G | 115 | 2.24 | Comparative Example |
| S | R | 100 | 2.03 | Comparative Example |
| T | B | 156 | 2.35 | Present Invention |
| T | G | 158 | 2.39 | Present Invention |
| T | R | 150 | 2.43 | Present Invention |

From the results shown in Table 3, it can be recognized that when a color development accelerator is added to cyan couplers according to the present invention, sensitivity and $D_{max}$ can be increased even in the case of multilayer color print paper. It will be understood that the color development accelerator is effective on yellow couplers and magenta couplers used in the smaples.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer, said emulsion layer containing at least one cyan dye forming coupler represented by the general formula (I):

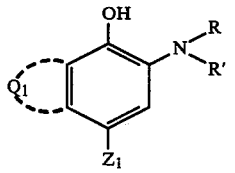

(I)

wherein, $Z_1$ represents a hydrogen atom or a group that can be released in a coupling reaction with the oxidation product of a color developing agent;

R represents an acyl group or a sulfonyl group; and wherein

R' represents a hydrogen atom or an aliphatic group having 1 to 8 carbon atoms which may be substituted with one or more substituents;

$Q_1$ represents a 5- to 8-membered ring comprising —$NR'_3CO$—$Q'_1$, wherein the nitrogen atom of the group —$NR'_3CO$—$Q'_1$ is bonded to the carbon atom at the 5-position of the phenol ring portion of formula (I), wherein $Q'_1$ represents at least one divalent group selected from the group consisting of a divalent amino group, an ether linkage, a thioether linkage, an alkylene group, an ethylene linkage, an imino linkage, a sulfonyl group, a carbonyl group, an allylene group, a divalent heterocyclic ring group and a group represented by

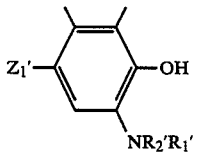

wherein $Z'_1$ and $R'_2$ have the same meaning as $Z_1$ and R', respectively, as defined above; $R'_1$ represents a group represented by —$COX_1$—$R'_4$ or a group represented by —$SO_2$—$X_1R'_4$ wherein $X_1$ represents a group —O—, a group —$NR'_5$— or a chemical bond wherein $R'_5$ represents a hydrogen atom or a substituted or unsubstituted aliphatic group having 1 to 8 carbon atoms, and $R'_4$ represents a substituted or unsubstituted aliphatic group; $Z'_1$, $R'_1$ and $R_2$ may be the same or different, and $Q'_1$ may be substituted or unsubstituted; $R'_3$ represents a hydrogen atom or a group represented by —$X_2R'_6$ that can be attached as a substituent to the nitrogen atom, wherein $X_2$ represents a chemical bond or one or more divalent linking groups that may have a substituent selected from the group consisting of a divalent amino group, an ether linkage, a thioether linkage, an alkylene group, an imino linkage, a sulfonyl group, a sulfoxy group, and a carbonyl group; and $R'_6$ has the same meaning as $R'_4$; and a dimer coupler or a polymer coupler may be formed through R, R', $Z_1$, or $Q_1$;

and at least one color development accelerator represented by the formulae (II) or (V):

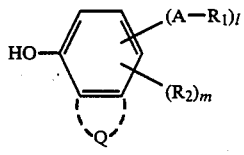

(II)

$R_5$—$NHSO_2$—$R_6$ (V)

wherein,

A represents a divalent electron accepting group;

$R_1$ represents a substituted or unsubstituted aliphatic group, a substituted or unsubstituted aryl group, a substituted or unsubstituted alkoxy group, a substituted or unsubstituted aryloxy group, a substituted or unsubstituted alkylamino group, a substituted or unsubstituted anilino group, or a substituted or unsubstituted heterocyclic group;

l is 1 or 2;

$R_2$ represents a substituted or unsubstituted aliphatic group, a substituted or unsubstituted alkoxy group, a hydroxyl group or a halogen atom;

m is an integer of from 0 to 4;

Q, which may or may not be present, represents a benzene ring or a heterocyclic ring that may be condensed with the phenol ring;

$R_5$ represents a substituted or unsubstituted aliphatic group, a substituted or unsubstituted aryl group, a substituted or unsubstituted alkylsulfonyl or phenysulfonyl group or a substituted or unsubstituted acyl group; and $R_6$ represents a substituted or unsubstituted aliphatic group or a substituted or unsubstituted aryl group; or $R_5$ and $R_6$ may combine to form a 5- to 7-membered ring, which ring may be independent or may be part of a fused ring system.

2. A silver halide color photographic material as claiemd in claim 1, wherein the at least one color development accelerator is co-dispersed together with an oil-soluble coupler and is used in an amount of 20 to 300 mol % relative to the number of mols of the oil-soluble coupler.

3. A silver halide color photographic material as claimed in claim 1, wherein $Z_1$ represents a hydrogen atom, a halogen atom, an aryloxy group, or an alkoxy group.

4. A silver halide color phtographic material as claimed in claim 1, wherein $R'_3$ represents a hydrogen atom or an alkyl group.

5. A silver halide color photographic material as claimed in claim 1, wherein $R'_1$ represents a group represented by —$COX_1$—$R'_4$ wherein $X_1$ represents a group —0—, a group —NR'$_5$— or a chemical bond wherein R'$_5$ represents a hydrogen atom or a substituted or unsubstituted aliphatic group having 1 to 8 carbon atoms, and R'$_4$ represents a substituted or unsubstituted aliphatic group.

6. A silver halide color photographic material as claimed in claim 1, wherein R' represents a hydrogen atom.

7. A silver halide color photographic material as claimed in claim 1, wherein A of the formula (II) represents $$-SO_2-,\ -SO-,\ -CO-,\ -\overset{\overset{\displaystyle O}{\|}}{\underset{\underset{\displaystyle OC_2H_5}{|}}{P}}-\ ,\ \text{or}\ -\overset{\overset{\displaystyle O}{\|}}{\underset{\underset{\displaystyle OC_8H_{17}}{|}}{P}}-\ .$$

8. A silver halide color photographic material as claimed in claim 1, wherein the at least one color development accelerator is co-dispersed together with an oil-soluble coupler and is used in an amount of 40 to 150 mol % relative to the number of mols of the oil-soluble coupler.

9. A silver halide color photographic material as claimed in claim 1, wherein the at least one color development accelerator is represented by formula (II).

10. A silver halide color photographic material as claimed in claim 9, wherein A represents —CO—.

* * * * *